US007693598B2

(12) United States Patent
Yamada

(10) Patent No.: US 7,693,598 B2
(45) Date of Patent: Apr. 6, 2010

(54) EMBROIDERY DATA CREATION APPARATUS AND EMBROIDERY DATA CREATION PROGRAM RECORDED IN COMPUTER-READABLE RECORDING MEDIUM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 560 days.

(21) Appl. No.: 11/730,490

(22) Filed: Apr. 2, 2007

(65) Prior Publication Data

US 2007/0233309 A1 Oct. 4, 2007

(30) Foreign Application Priority Data

Apr. 3, 2006 (JP) ..... 2006-101601

(51) Int. Cl.
*D05C 5/02* (2006.01)

(52) U.S. Cl. ..... 700/138; 112/102.5; 112/470.01

(58) Field of Classification Search ..... 700/136–138; 112/102.5, 470.01, 470.06, 475.18, 475.19
See application file for complete search history.

(56) References Cited

U.S. PATENT DOCUMENTS 5,343,401 A * 8/1994 Goldberg et al. ..... 700/138
5,751,583 A * 5/1998 Kyuno et al. ..... 700/137
5,794,553 A * 8/1998 Futamura ..... 112/102.5
5,839,380 A * 11/1998 Muto ..... 112/102.5
6,167,823 B1 * 1/2001 Laufer et al. ..... 112/102.5
6,192,292 B1 * 2/2001 Taguchi ..... 700/138
6,324,441 B1 * 11/2001 Yamada ..... 700/138
6,629,015 B2 9/2003 Yamada
6,937,919 B1 * 8/2005 Muto et al. ..... 700/138
2005/0171628 A1 * 8/2005 Suzuki et al. ..... 700/138

FOREIGN PATENT DOCUMENTS

JP 2001-A-259268 9/2001
JP 2003-A-154181 5/2003

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

To provide an embroidery data creation apparatus, an embroidery data creation program, and a recording medium that records the embroidery data creation program, which create embroidery data for embroidery that is clear and sharp even when the tint or output size of an image is changed. The number of pixels necessary to create embroidery data is determined from thread density, size of the embroidery, and copied color data. Initial angle information is created from angle data and the angle information having necessary pixel configuration is re-computed from the initial angle information. Then, line segment data is created from the re-computed angle information, color data is created from the size adjusted color data and the line segment data, and the embroidery data is created from the line segment data and the color data.

24 Claims, 36 Drawing Sheets

FIG. 8

590

| | | |
|---|---|---|
| 100 | 50 | 50 |
| 200 | 100 | 50 |
| 200 | 200 | 100 |

FIG. 9

591

| | | |
|---|---|---|
| 50 | 0 | * |
| 100 | 50 | * |
| 0 | 100 | * |

FIG. 11

593

| | | |
|---|---|---|
| 100 | 50 | 0 |
| 0 | 100 | 50 |
| * | * | * |

594

| | | |
|---|---|---|
| * | 150 | 50 |
| * | 100 | 150 |
| * | * | * |

FIG. 13

511

| | | HORIZONTAL | | | | |
|---|---|---|---|---|---|---|
| | | 1 | 2 | 3 | ··· | 150 |
| VERTICAL | 1 | 10 | 15 | 71 | ··· | 24 |
| | 2 | 80 | 100 | 42 | ··· | 35 |
| | 3 | 35 | 12 | 5 | ··· | 9 |
| | ⋮ | ⋮ | ⋮ | ⋮ | ⋮ | ⋮ |
| | 150 | 4 | 33 | 49 | 18 | 45 |

FIG. 14

521

| | | HORIZONTAL | | | | | | |
|---|---|---|---|---|---|---|---|---|
| | | 1 | 2 | 3 | 4 | ··· | 299 | 300 |
| VERTICAL | 1 | 10 | | 15 | | ··· | 24 | |
| | 2 | | | | | ··· | | |
| | 3 | 80 | | 100 | | ··· | 35 | |
| | 4 | | | | | ··· | | |
| | ⋮ | ⋮ | ⋮ | ⋮ | ⋮ | ⋮ | ⋮ | ⋮ |
| | 299 | 4 | | 33 | | ··· | 45 | |
| | 300 | | | | | ··· | | |

FIG. 15

531

| | | HORIZONTAL | | | | | | |
|---|---|---|---|---|---|---|---|---|
| | | 1 | 2 | 3 | 4 | ··· | 299 | 300 |
| VERTICAL | 1 | 10 | 10 | 15 | 15 | ··· | 24 | 24 |
| | 2 | 10 | 10 | 15 | 15 | ··· | 24 | 24 |
| | 3 | 80 | 80 | 100 | 100 | ··· | 35 | 35 |
| | 4 | 80 | 80 | 100 | 100 | ··· | 35 | 35 |
| | ⋮ | ⋮ | ⋮ | ⋮ | ⋮ | ⋮ | ⋮ | ⋮ |
| | 299 | 4 | 4 | 33 | 33 | ··· | 45 | 45 |
| | 300 | 4 | 4 | 33 | 33 | ··· | 45 | 45 |

FIG. 16

532

| | | HORIZONTAL | | | | | | |
|---|---|---|---|---|---|---|---|---|
| | | 1 | 2 | 3 | 4 | ··· | 299 | 300 |
| VERTICAL | 1 | 10 | 0 | 15 | 0 | ··· | 24 | 0 |
| | 2 | 0 | 0 | 0 | 0 | ··· | 0 | 0 |
| | 3 | 80 | 0 | 100 | 0 | ··· | 35 | 0 |
| | 4 | 0 | 0 | 0 | 0 | ··· | 0 | 0 |
| | ⋮ | ⋮ | ⋮ | ⋮ | ⋮ | ⋮ | ⋮ | ⋮ |
| | 299 | 4 | 0 | 33 | 0 | ··· | 45 | 0 |
| | 300 | 0 | 0 | 0 | 0 | ··· | 0 | 0 |

FIG. 17

513

| | | HORIZONTAL | | | | |
|---|---|---|---|---|---|---|
| | | 1 | 2 | 3 | ··· | 200 |
| VERTICAL | 1 | 10 | 15 | 71 | ··· | 45 |
| | 2 | 80 | 100 | 42 | ··· | 77 |
| | 3 | 35 | 12 | 5 | ··· | 82 |
| | ⋮ | ⋮ | ⋮ | ⋮ | ⋮ | ⋮ |
| | 200 | 11 | 34 | 12 | 79 | 34 |

FIG. 18

523

| | | HORIZONTAL | | | | | | | | |
|---|---|---|---|---|---|---|---|---|---|---|
| | | 1 | 2 | 3 | 4 | 5 | 6 | ··· | 599 | 600 |
| VERTICAL | 1 | 10 | 10 | 10 | 15 | 15 | 15 | ··· | 45 | 45 |
| | 2 | 10 | 10 | 10 | 15 | 15 | 15 | ··· | 45 | 45 |
| | 3 | 10 | 10 | 10 | 15 | 15 | 15 | ··· | 45 | 45 |
| | 4 | 80 | 80 | 80 | 100 | 100 | 100 | ··· | 77 | 77 |
| | 5 | 80 | 80 | 80 | 100 | 100 | 100 | ··· | 77 | 77 |
| | 6 | 80 | 80 | 80 | 100 | 100 | 100 | ··· | 77 | 77 |
| | ⋮ | ⋮ | ⋮ | ⋮ | ⋮ | ⋮ | ⋮ | ⋮ | ⋮ | ⋮ |
| | 599 | 11 | 11 | 11 | 34 | 34 | 34 | ··· | 34 | 34 |
| | 600 | 11 | 11 | 11 | 34 | 34 | 34 | ··· | 34 | 34 |

FIG. 19

524

| | | HORIZONTAL | | | | | | | | |
|---|---|---|---|---|---|---|---|---|---|---|
| | | 1 | 2 | 3 | 4 | 5 | 6 | ··· | 599 | 600 |
| VERTICAL | 1 | 10 | 10 | 10 | 15 | 15 | 15 | ··· | 45 | 45 |
| | 2 | 10 | 10 | 10 | 15 | 15 | 15 | ··· | 45 | 45 |
| | 3 | 10 | 10 | 10 | 15 | 15 | 15 | ··· | 45 | 45 |
| | 4 | 80 | 80 | 80 | 100 | 100 | 100 | ··· | 77 | 77 |
| | 5 | 80 | 80 | 80 | 100 | 100 | 100 | ··· | 77 | 77 |
| | 6 | 80 | 80 | 80 | 100 | 100 | 100 | ··· | 77 | 77 |
| | ⋮ | ⋮ | ⋮ | ⋮ | ⋮ | ⋮ | ⋮ | ⋮ | ⋮ | ⋮ |
| | 599 | 11 | 11 | 11 | 34 | 34 | 34 | ··· | 34 | 34 |
| | 600 | 11 | 11 | 11 | 34 | 34 | 34 | ··· | 34 | 34 |

FIG. 20

533

| | | HORIZONTAL | | | | | |
|---|---|---|---|---|---|---|---|
| | | 1 | 2 | 3 | 4 | ··· | 300 |
| VERTICAL | 1 | 10 | 13 | 15 | 60 | ··· | 24 |
| | 2 | 45 | 51 | 58 | 8 | ··· | 77 |
| | 3 | 80 | 90 | 100 | 31 | ··· | 9 |
| | 4 | 41 | 68 | 27 | 11 | ··· | 16 |
| | ⋮ | ⋮ | ⋮ | ⋮ | ⋮ | ⋮ | ⋮ |
| | 300 | 4 | 33 | 49 | 21 | 18 | 45 |

FIG. 21

516

| | | HORIZONTAL | | | | | | |
|---|---|---|---|---|---|---|---|---|
| | | 1 | 2 | 3 | 4 | ··· | 199 | 200 |
| VERTICAL | 1 | 10 | 10 | 15 | 15 | ··· | 24 | 24 |
| | 2 | 10 | 10 | 15 | 15 | ··· | 24 | 24 |
| | 3 | 80 | 80 | 100 | 100 | ··· | 35 | 35 |
| | 4 | 80 | 80 | 100 | 100 | ··· | 35 | 35 |
| | ⋮ | ⋮ | ⋮ | ⋮ | ⋮ | ⋮ | ⋮ | ⋮ |
| | 199 | 4 | 4 | 33 | 33 | ··· | 45 | 45 |
| | 200 | 4 | 4 | 33 | 33 | ··· | 45 | 45 |

FIG. 22

536

| | | HORIZONTAL | | | | |
|---|---|---|---|---|---|---|
| | | 1 | 2 | 3 | ··· | 100 |
| VERTICAL | 1 | 10 | 15 | 71 | ··· | 24 |
| | 2 | 80 | 100 | 42 | ··· | 35 |
| | 3 | 35 | 12 | 5 | ··· | 9 |
| | ⋮ | ⋮ | ⋮ | ⋮ | ⋮ | ⋮ |
| | 100 | 4 | 33 | 49 | 18 | 45 |

FIG. 23

517

| | | HORIZONTAL | | | | | |
|---|---|---|---|---|---|---|---|
| | | 1 | 2 | 3 | 4 | ··· | 300 |
| VERTICAL | 1 | 10 | 89 | 15 | 60 | ··· | 24 |
| | 2 | 63 | 37 | 25 | 8 | ··· | 35 |
| | 3 | 80 | 4 | 100 | 31 | ··· | 9 |
| | 4 | 41 | 68 | 27 | 11 | ··· | 16 |
| | ⋮ | ⋮ | ⋮ | ⋮ | ⋮ | ⋮ | ⋮ |
| | 300 | 4 | 33 | 49 | 21 | 18 | 45 |

FIG. 24

527

| | | HORIZONTAL | | | | | | | | |
|---|---|---|---|---|---|---|---|---|---|---|
| | | 1 | 2 | 3 | 4 | 5 | 6 | ··· | 599 | 600 |
| VERTICAL | 1 | 10 | 10 | 89 | 89 | 15 | 15 | ··· | 24 | 24 |
| | 2 | 10 | 10 | 89 | 89 | 15 | 15 | ··· | 24 | 24 |
| | 3 | 63 | 63 | 37 | 37 | 25 | 25 | ··· | 35 | 35 |
| | 4 | 63 | 63 | 37 | 37 | 25 | 25 | ··· | 35 | 35 |
| | 5 | 80 | 80 | 4 | 4 | 100 | 100 | ··· | 9 | 9 |
| | 6 | 80 | 80 | 4 | 4 | 100 | 100 | ··· | 9 | 9 |
| | ⋮ | ⋮ | ⋮ | ⋮ | ⋮ | ⋮ | ⋮ | ⋮ | ⋮ | ⋮ |
| | 599 | 4 | 4 | 33 | 33 | 49 | 49 | ··· | 45 | 45 |
| | 600 | 4 | 4 | 33 | 33 | 49 | 49 | ··· | 45 | 45 |

FIG. 25

528

| | | HORIZONTAL | | | | | | | | |
|---|---|---|---|---|---|---|---|---|---|---|
| | | 1 | 2 | 3 | 4 | 5 | 6 | ··· | 599 | 600 |
| VERTICAL | 1 | 10 | 10 | 89 | 89 | 15 | 15 | ··· | 24 | 24 |
| | 2 | 10 | 10 | 89 | 89 | 15 | 15 | ··· | 24 | 24 |
| | 3 | 63 | 63 | 37 | 37 | 25 | 25 | ··· | 35 | 35 |
| | 4 | 63 | 63 | 37 | 37 | 25 | 25 | ··· | 35 | 35 |
| | 5 | 80 | 80 | 4 | 4 | 100 | 100 | ··· | 9 | 9 |
| | 6 | 80 | 80 | 4 | 4 | 100 | 100 | ··· | 9 | 9 |
| | ⋮ | ⋮ | ⋮ | ⋮ | ⋮ | ⋮ | ⋮ | ⋮ | ⋮ | ⋮ |
| | 599 | 4 | 4 | 33 | 33 | 49 | 49 | ··· | 45 | 45 |
| | 600 | 4 | 4 | 33 | 33 | 49 | 49 | ··· | 45 | 45 |

FIG. 26

537

| | | HORIZONTAL | | | |
|---|---|---|---|---|---|
| | | 1 | 2 | ··· | 200 |
| VERTICAL | 1 | 42 | 36 | ··· | 24 |
| | 2 | 46 | 55 | ··· | 35 |
| | ⋮ | ⋮ | ⋮ | ⋮ | ⋮ |
| | 200 | 4 | 33 | ··· | 45 |

EMBROIDERY DATA CREATION APPARATUS AND EMBROIDERY DATA CREATION PROGRAM RECORDED IN COMPUTER-READABLE RECORDING MEDIUM

This application claims priority from JP 2006-101601, filed Apr. 3, 2006, the entire disclosure of which is incorporated herein by reference thereto.

BACKGROUND

The present disclosure relates to an embroidery data creation apparatus and an embroidery data creation program recorded in a computer-readable recording medium.

Conventionally, photograph embroidery has been done wherein images of photographs taken by a digital camera or those printed from films are embroidered. In this photograph embroidery, image data of photographs taken by a digital camera or image data of photographs printed from films that is captured by a scanner is used. Then, line segment data showing a shape of stitches of a thread and color data showing a stitch color is created from the image data, and embroidery data showing stitches of each thread color is thus created. In an embroidery data creation apparatus that creates such embroidery data, line segment data showing a shape of stitches of a thread is created to bring a result of an embroidery closer to photographic images. When creating the line segment data, like that disclosed in Japanese Patent Application Laid-Open No. 2001-259268, rather than embroidering such that all stitches have the same angle on a cloth, an embroidery data creation apparatus that is capable of stitching in various angles in all 360 degrees has been proposed. To be specific, for each pixel composing image data, a direction of stitches (angle characteristic) to be arranged on the pixel based on a relationship with surrounding pixels and strength thereof (strength of the angle characteristic) is computed. The angle characteristics and the strength of the angle characteristic are used to create the line segment data. The strength of angle characteristic is computed based on luminance of the surrounding pixels of the watched pixel, and the bigger the difference in luminance from the surrounding is, the greater the value of the strength of the angle characteristic. In addition, an embroidery data creation apparatus described in Japanese Patent Application Laid-Open No. 2003-154181 creates line segment data that assigns a thickness of one stitch (one thread) to one pixel and shows a shape of the stitch.

SUMMARY

However, like an embroidery data creation apparatus described in Japanese Patent Application Laid-Open No. HEI6-284236, if the number of threads to be arranged vertically and horizontally in an embroidery area is greater than the number of vertical and horizontal pixels in image data when it creates line segment data by assigning one thread to one pixel, the image data needs to be expanded. When an image is expanded, in general, the expanded image is unclear and blurred as a whole. Like in an embroidery data creation apparatus described in Japanese Patent Application Laid-Open No. 2001-259268, if an image data is unclear and blurred as a whole when an angle characteristic strength is utilized, a difference in luminance from that of surrounding pixels is often small. Thus, there is the problem that a value of angle characteristic strength is also small and the result of embroidery is also blurred and unclear as a whole. Then, a method is possible wherein image data is sharpened to make an image clear. In this case, as a value of the angle characteristic strength is higher, the result of embroidery is clear. There is another problem, however, that as contrasting density of an image intensifies due to sharpening, a tint of the embroidery result differs from the original image data. In addition, if the number of vertical and horizontal pixels of image data is greater than the number of threads to be arranged vertically and horizontally on an embroidery area, the image data needs to be reduced. When an image is reduced, in general, the higher the ratio of reduction is, more details of the reduced image may be collapsed. Thus, there is a problem that a useful angle characteristic strength may not be obtained as the resultant image has a different impression in the details from the original image. In addition, even when the tint of an image is changed, an angle characteristic strength may decrease. For instance, when an original image data is dark, embroidery data to be created is also dark. Thus, a method is possible wherein an image is made bright by processing image data to increase luminosity. In this case, an embroidery results as well as image data will be brighter. There is a problem, however, that as contrasting density of the image is lower as the entire image is brighter, the angle characteristic strength is small as a whole, making the embroidery result blurred and unclear as a whole.

To solve the problems described above, this disclosure has been developed. It is an object of the disclosure to provide an embroidery data creation apparatus and an embroidery data creation program recorded in a computer-readable recording medium that can create embroidery data for embroidering that remains clear and sharp even after adjustments have been made to the original size or tint of the image.

To solve the problems described above, an embroidery data creation apparatus in a first aspect of this disclosure includes an angle data creation device that creates angle data from image data comprised of a collection of pixels and that forms an image, wherein the angle data determines an angle characteristic that represents a direction in which level of color continuity is high and an angle characteristic strength that represents strength of the continuity, for each pixel in the image data; a color data creation device that creates color data from the image data, wherein the color data determines a thread color to be used in a sewing machine for embroidering an image corresponding to the embroidery data; an angle information computing device that computes the angle characteristic and the angle characteristic strength for each pixel of the angle data created by the angle data creation device; an angle information storage device that stores, as angle information, the angle characteristic and the angle characteristic strength computed by the angle information computing device; an image data scaling device that expands or reduces a size of the color data by adding or removing the number of pixels comprising the color data, depending on a size of the embroidery data to be created; an angle information re-computing device that re-computes the angle information for each pixel of the color data, if the size of the color data expanded or reduced by the image data scaling device differs from that of the angle data; an angle information storage control device that re-stores the angle characteristic and the angle characteristic strength computed by the angle information re-computing device as angle information in the angle information storage device; a line segment data creation device that creates line segment data that represents line segments that are traces of threads to be arranged on respective pixels, based on the angle information stored in the angle information storage device; a color data creation device that creates color data that represents a thread color of each line segment of the line segment data created by the line segment data creation device based on the color data; and an embroidery data creation device that creates the embroidery data based on the line segment data created by the line segment data creation device and the color data created by the color data creation device.

In addition, in a second aspect of this disclosure, an angle data creation step that creates angle data from image data comprised of a collection of pixels and that forms an image, wherein the angle data determines an angle characteristic that represents a direction in which level of color continuity is high and an angle characteristic strength that represents the strength of continuity, for each pixel in the image data; a color data creation step that creates color data from the image data, wherein the color data determines a thread color to be used in a sewing machine for embroidering an image corresponding to the embroidery data; an angle information computing step that computes the angle characteristic and the angle characteristic strength for each pixel of the angle data created in the angle data creation step; an angle information storage step that stores, as angle information, the angle characteristic and the angle characteristic strength computed in the angle information computing step; an image data scaling step that expands or reduces a size of the color data by adding or removing the number of pixels comprising the color data, depending on a size of the embroidery data to be created; an angle information re-computing step that re-computes the angle information for each pixel of the color data, if the size of the color data that is expanded or reduced in the image data scaling step differs from that of the angle data; an angle information re-storage step that re-stores the angle characteristic and the angle characteristic strength computed in the angle information re-computing step as angle information; a line segment data creation step that creates line segment data that represents line segments that are traces of threads to be arranged on respective pixels based on either the angle information stored in the angle information storage step or the angle information stored in the angle information re-storage step if the angle information re-storage step was performed; a color data creation step that creates color data that represents a thread color of each line segment of the line segment data created in the line segment data creation step, based on the color data; and an embroidery data creation step that creates the embroidery data based on the line segment data created in the line segment data creation step and the color data created in the color data creation step.

BRIEF DESCRIPTION OF THE DRAWINGS

Exemplary embodiments will be described below in detail with reference to the accompanying drawings in which:

FIG. 8 is a schematic view showing luminance values of a specific pixel and its surrounding pixels;

FIG. 9 is a schematic view showing a result of computation of an absolute value of a difference from pixel data in the right direction to each pixel;

FIG. 11 is a schematic view showing a result of computation of an absolute value of a difference from pixel data in the down direction to each pixel;

FIG. 13 is a schematic view partially showing only angle characteristic strength of initial angle information before expansion;

FIG. 14 is a schematic view partially showing only angle characteristic strength of re-computed angle information when a schematic view is expanded twice.

FIG. 15 is a schematic view partially showing only angle characteristic strength of re-computed angle information according to a first expansion computing method;

FIG. 16 is a schematic view partially showing only angle characteristic strength of re-computed angle information according to a second expansion computing method;

FIG. 17 is a schematic view partially showing only angle characteristic strength of initial angle information before expansion;

FIG. 18 is a schematic view showing configuration of a calculation process array partially indicating the angle characteristic strength in the course of calculation in re-computation according to a third expansion computing method;

FIG. 19 is a schematic view showing configuration of a calculation process array partially indicating the angle characteristic strength in the course of calculation according to a third expansion computing method;

FIG. 20 is a schematic view partially showing only angle characteristic strength of re-computed angle information according to a third expansion computing method;

FIG. 21 is a schematic view partially showing only angle characteristic strength of initial angle information before reduction;

FIG. 22 is a schematic view partially showing only angle characteristic strength of re-computed angle information according to a first reduction computing method;

FIG. 23 is a schematic view partially showing angle characteristic strength of initial angle information before reduction;

FIG. 24 is a schematic view showing configuration of a calculation process array in the course of calculation in re-computation according to a second reduction computing method;

FIG. 25 is a schematic view showing configuration of a calculation process array in the course of calculation in re-computation according to a second reduction computing method;

FIG. 26 is a schematic view partially showing angle characteristic strength of re-computed angle information according to a second reduction computing method;

DETAILED DESCRIPTION OF EMBODIMENTS

Figure 1:
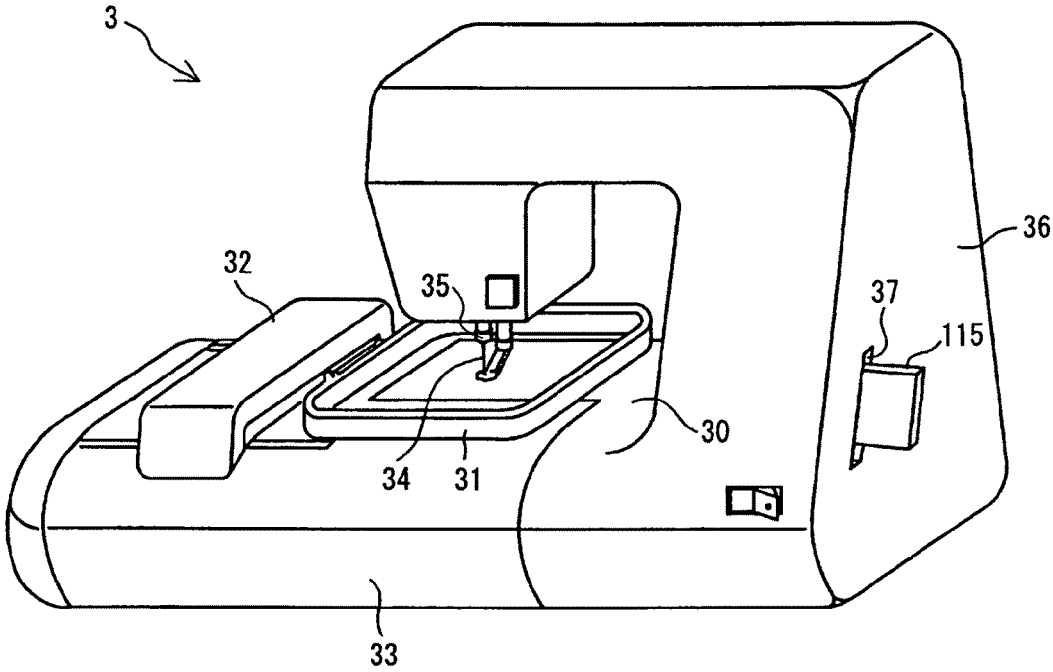
FIG. 1 is an outline view of an embroidery sewing machine.

The following describes one embodiment of an embroidery data creation apparatus 1 according to this disclosure with reference to the drawings. The embroidery data creation apparatus 1 of this embodiment creates embroidery data for outputting a design represented by image data through embroidery by means of an embroidery sewing machine 3, based on the image data. First, the embroidery sewing machine 3 is described below.

The embroidery sewing machine 3 is configured to embroider a predetermined design on a work cloth by performing sewing operations, while moving an embroidery frame 31 holding this work cloth to a predetermined position indicated by an X-Y coordinate system specific to the apparatus. The embroidery frame 31 is arranged on the sewing machine bed 30, and moved by a Y-directional drive section 32 and an X-directional drive mechanism contained in a body case 33. Sewing is performed by a sewing needle 34 and a shuttle mechanism (not shown). The Y-directional drive section 32, X-directional drive mechanism, a needle bar 35, etc. is controlled by a control apparatus constituted of a microcomputer etc. incorporated in the embroidery sewing machine 3. In addition, a memory card slot 37 is mounted on a side surface of a pillar 36 of the embroidery sewing machine 3. When a memory card 115 in which embroidery data is stored is inserted into the memory card slot 37, the embroidery data created by the embroidery data creation apparatus 1 is supplied.

In the following, the embroidery data creation apparatus 1 is described with reference to the drawings.

Figure 2:
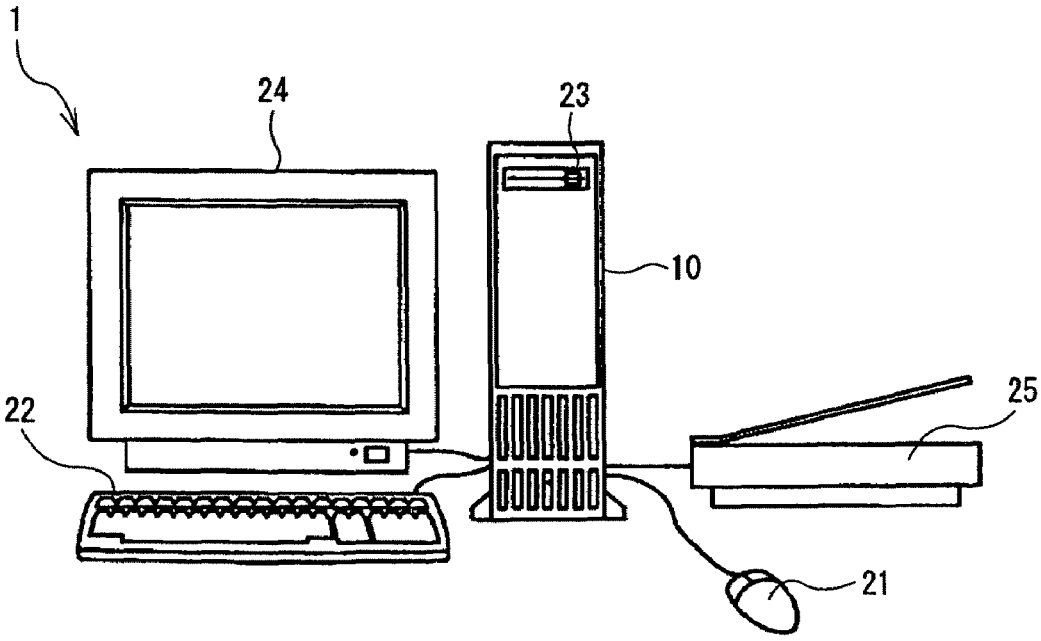
FIG. 2 is an overall configuration diagram showing physical configuration of an embroidery data creation apparatus.

As shown in FIG. 2, the embroidery data creation apparatus 1 is comprised of an apparatus body 10 that is a so-called personal computer, a mouse 21, a keyboard 22, a memory card connector 23, a display 24, and an image scanner apparatus 25 that are connected to the apparatus body 10. The configuration of the apparatus body 10, mouse 21, keyboard 22, memory card connector 23, display 24, and the image scanner apparatus 25 are not limited to that shown in FIG. 2. For instance, the apparatus body 10 is not limited to that of tower type, and may be horizontal type (flatbed type). A notebook type in which the apparatus body 10, display 24, and keyboard 22 are integrated is also acceptable. In addition, needless to say, the apparatus body 10 may not be a so-called personal computer but a specialized machine.

Figure 3:
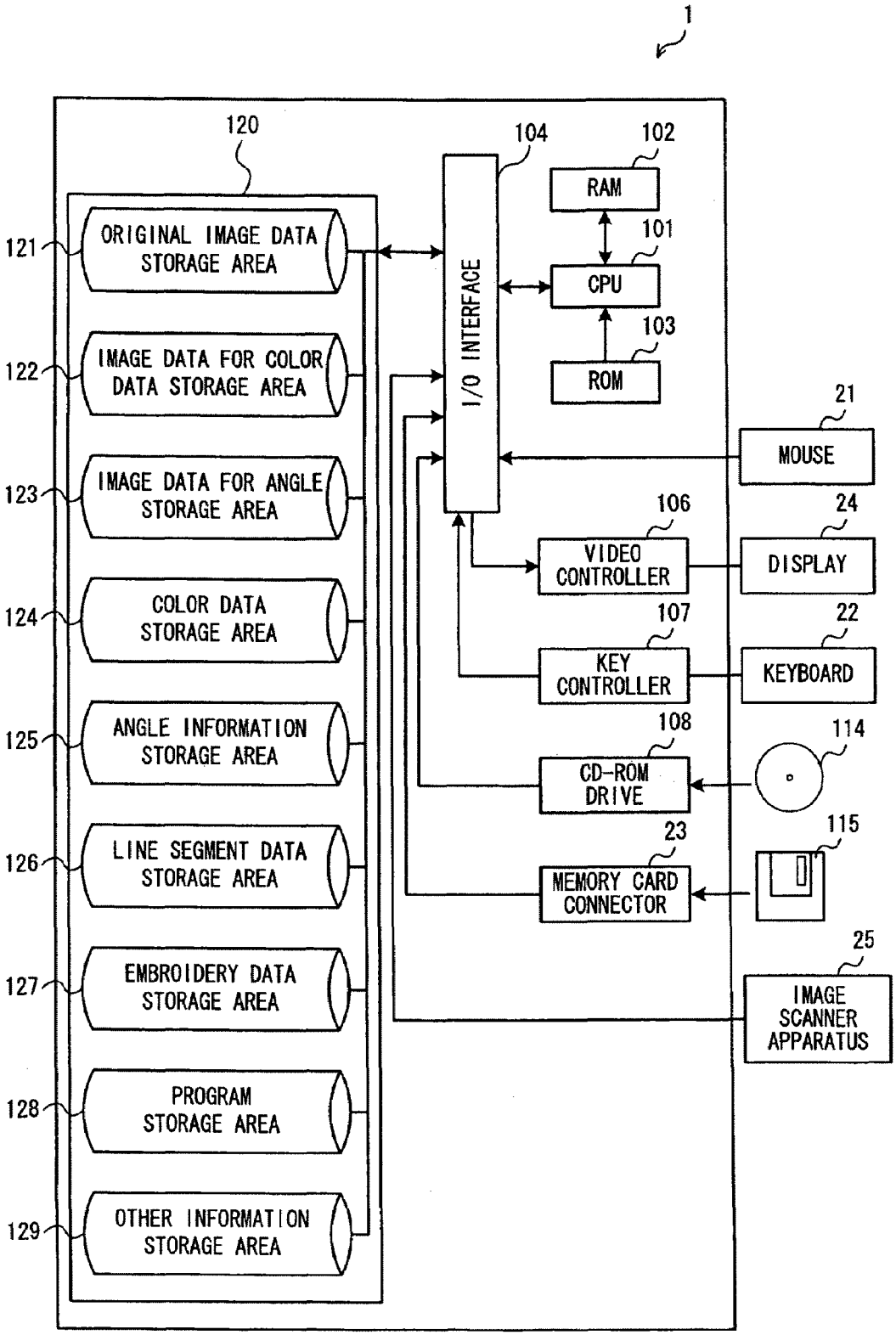
FIG. 3 is a block diagram showing electrical configuration of an embroidery data creation apparatus.

Now, electrical configuration of the embroidery data creation apparatus 1 is described with reference to the block diagram of FIG. 3. As shown in FIG. 3, in the embroidery data creation apparatus 1 is provided with a CPU 101 as a controller which controls the embroidery data creation apparatus 1. To the CPU 101 are connected a RAM 102 that temporarily stores various types of data, a ROM 103 that has stored BIOS, etc., and an I/O interface 104 that serves as an intermediary in data passing. A hard disk apparatus 120 is connected to the I/O interface 104. In the hard disk apparatus 120, an original image data storage area 121, an image data for color storage area 122, an image data for angle storage area 123, a color data storage area 124, an angle information storage area 125, a line segment data storage area 126, an embroidery data storage area 127, a program storage area 128, and other information storage area 129 are at least provided.

Original image data 100 (see FIG. 4.) read by the image scanner apparatus 25 is stored in the original image data storage area 121. Image data for color 200 (see FIG. 4) for creating color data 400 (see FIG. 4) is stored in the image data for color storage area 122. Image data for angle 300 (see FIG. 4) for computing angle information 500 (see FIG. 4), to be discussed later, is stored in the image data for angle storage area 123. The color data 400 to be created from the image data for color 200 is stored in the color data storage area 124. The angle information 500 to be created from the image data for angle 300 is stored in the angle information storage area 125. Line segment data 600 (see FIG. 4) created from the angle information 500 is stored in the line segment data storage area 126. Embroidery data 700 (see FIG. 4) to be created from the color data 400 and the line segment data 600 is stored in the embroidery data storage area 127. An embroidery data creation program to be executed in the CPU 101 is stored in the program storage area 128. Other information to be used in the embroidery data creation apparatus 1 is stored in the other information storage area 129. In the case of a specialized machine in which an embroidery data creation apparatus 1 is not equipped with a hard disk apparatus 120, the program is stored in ROM.

In addition, the mouse 21, a video controller 106, a key controller 107, a CD-ROM drive 108, the memory card connector 23, and the image scanner apparatus 25 are connected to the I/O interface 104. The display 24 is connected to the video controller 106, and the keyboard 22 is connected to the key controller 107. The embroidery data creation program that is a control program of the embroidery data creation apparatus 1 is stored in a CD-ROM 114 to be inserted into the CD-ROM drive 108. When installed, the control program is set up in the hard disk apparatus 120 from the CD-ROM 114 and stored in the program storage area 128. In addition, reading or writing of a memory card 115 is possible in the memory card connector 23.

Figure 4:
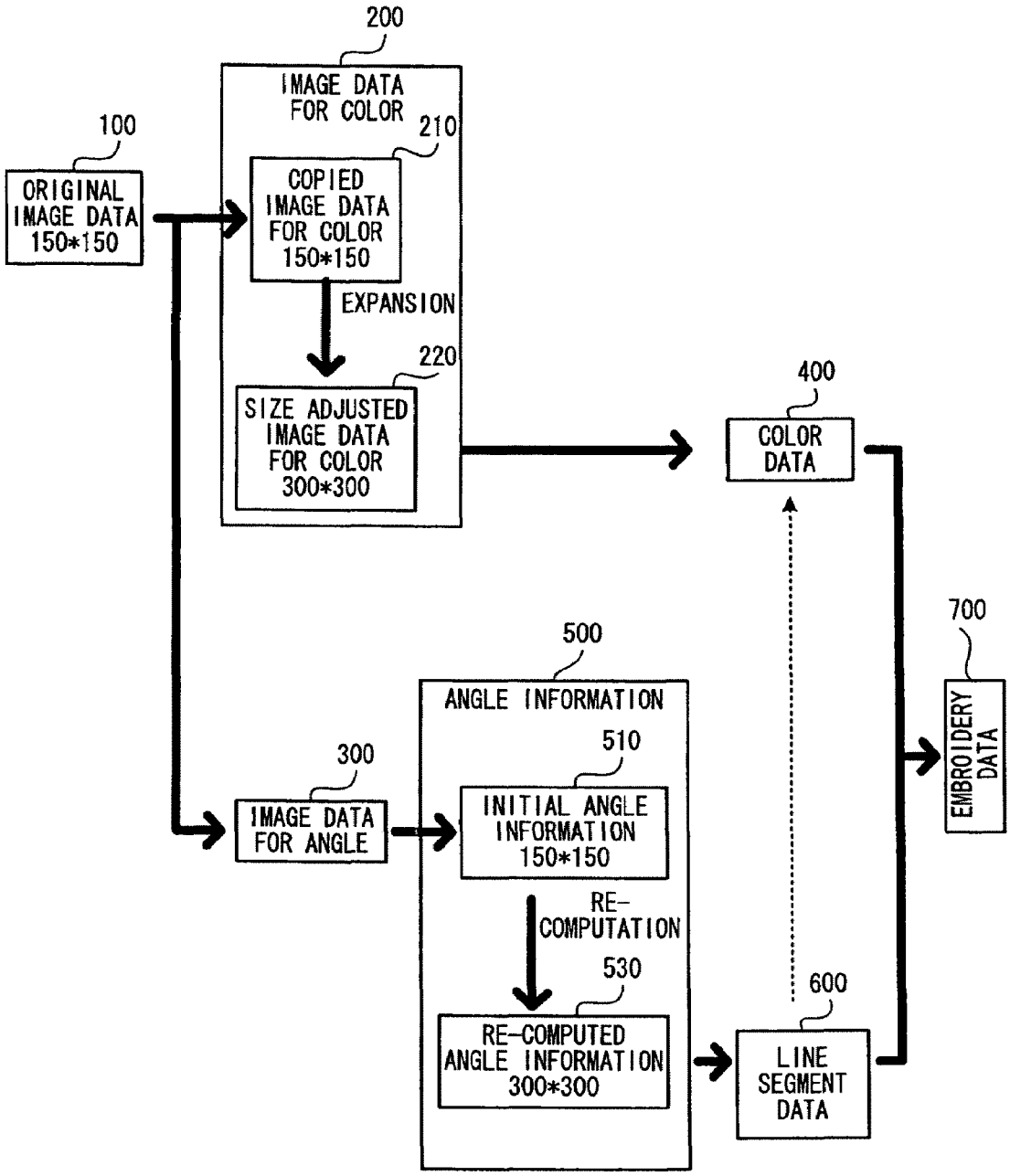
FIG. 4 is an information relationship diagram showing information used when embroidery data is created and a relationship thereof.

Now, information to be used in creating the embroidery data 700 from the original image data 100 is described with reference to FIG. 4. As shown in FIG. 4, the image data for color 200, the image data for angle 300, the color data 400, the angle information 500 and the line segment data 600 are used to create the embroidery data 700 from the original image data 100.

The original image data 100 is data scanned by the image scanner apparatus 25, data stored in an external recording medium such as the memory card 115 or CD-ROM 114, data stored in the hard disk apparatus 120, etc. In addition, the embroidery data 700 is information indicating how to move the sewing needle 34 with what color of thread, to do embroidery in the embroidery sewing machine 3. In the embroidery data 700, a "line segment" represents one stitch to be made by the sewing needle 34. The embroidery data 700 is created from the line segment data 600 representing stitches of embroidery as line segment and the color data 400 showing a thread color of each line segment. The line segment data 600 and the color data 400 are created from the original image data 100.

Now, finished size of embroidery to be actually done by the embroidery sewing machine 3 and size of the original image data 100 are reviewed. The original image data 100 forms an image by collections of substantially square pixels, and thus the size thereof can be seen as the number of pixels in the vertical direction and that in horizontal direction. On the one hand, the finished size of embroidery (embroidery result) can be viewed as the number of warps and that of wefts when an embroidery area is stitched with no gap. Wefts run across the width of a cloth and under the warp strings, between the knots. By matching the number of vertical pixels with the number of warps and the number of horizontal pixels with the number of wefts, one pixel can correspond to an area (hereinafter referred to as "unit area") specified by one warp and one weft in the embroidery area. This makes it possible to obtain embroidery result closer to the original image data 100.

Computation of the number of warps and that of wefts relates to vertical length and horizontal length of embroidery result, and thread density. For instance, when it is assumed that the thread density is 3 threads/1 mm and the embroidery size is 100 mm long and 100 mm wide, 300 warps and 300 wefts will be necessary to stitch the area without any gap. In fact, the embroidery area is viewed as a collection of unit areas of 300 units×300 units in length and width.

In addition, a color of thread in embroidery is desirably closer to a color of the stitch at a corresponding position on the original image data 100. Thus, the color data 400 is created, by matching a unit area where line segments representative of stitches are arranged with the pixels of the original image data 100, and referring to a color of the position where the line segment is arranged. Now, the embroidery data 700 in which the embroidery area is represented by the unit area of 300 units×300 units is created. Then, if the original image data 100 is formed by 300 pixels×300 pixels, there will be no problem as one pixel of the original image data 100 corresponds to one unit area. However, if the original image data 100 is not formed by 300 pixels×300 pixels, it is necessary to scale the original image data 100 to the desired size. For example, if the original image data 100 consists of 600 pixels×600 pixels, each unit area is scaled to represent 2×2 pixels of the original image data 100. In contrast, if the original image data 100 consists of 150 pixels×150 pixels, each unit area is scaled to represent ½ pixel×½ pixel.

The image data for color 200 for creating the color data 400 is created from the original image data 100. First, a copy of the original image data 100 is created as copied image data for color 210. Then, size adjusted image data for color 220 is created by scaling up or scaling down the copied image data for color 210 such that the pixel dimensions of the image data for color correspond to the unit areas. The copied image data for color 210 and the size adjusted image data for color 220 are collectively referred to as the image data for color 200. As an example, if the original image data 100 consists of 150 pixels×150 pixels, the copied image data for color 210 is created by simply copying the original image data 100. This copied image data for color 210 consists of 150 pixels×150 pixels. Then, the copied image data for color 210 is expanded to 300 pixels×300 pixels (the image data for size-adjusting color 220).

Next, creation of the line segment data 600 is described. The line segment data 600 is created based on the angle information 500 computed for each pixel of the image data for angle 300 from a copy of the original image data 100. The angle characteristic and angle characteristic strength, that comprise the angle information 500, are values computed for each pixel. The angle characteristic shows in which direction (angle) a color continues when a color of that pixel is compared with colors of surrounding pixels. The angle characteristic strength shows level of continuity. The angle characteristic does not view color continuity only with adjacent pixels but also color continuity in a wider area. In fact, it represents, in numerical terms, a direction one sees color continue when he/she looks at an image at a distance. Thus, when a line segment of one pixel is created, inclination of that line segment shall be an angle shown by the angle characteristic. Further, the angle characteristic strength is used in comparison with that of surrounding pixels, when it is determined whether to do embroidery represented by the line segment of the pixel or not to do embroidery by deleting the line segment. One example of the calculation method is described later.

Figure 5:
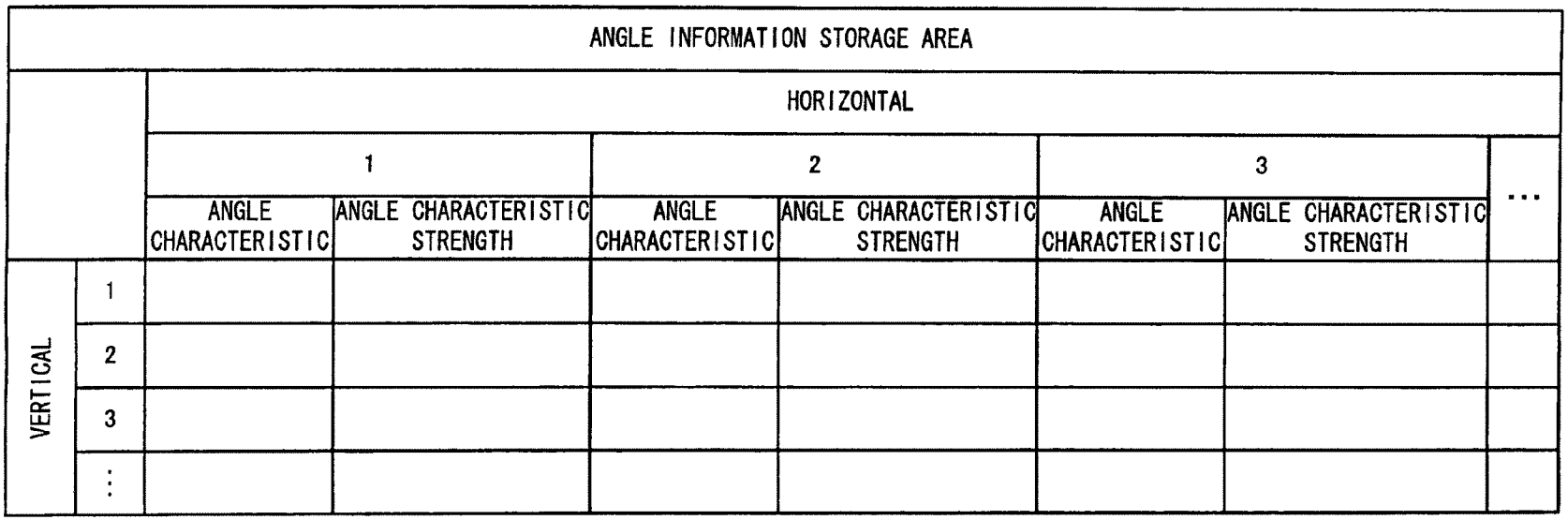
FIG. 5 is a schematic view showing configuration of an angle information storage area.

As shown in FIG. 5, the angle information 500 is stored as a two-dimensional array in the angle information storage area 125. For each vertical and horizontal pixel, the "Angle Characteristic" and "Angle Characteristic Strength" are stored as elements in the two-dimensional array. Thus, as many angle characteristics and angle characteristic strengths as number of pixels can be stored.

In the embroidery data creation apparatus 1 of this embodiment, the angle characteristic and the angle characteristic strength are computed for each pixel of the image data for angle 300. For instance, if the original image data 100 is image data consisting of 150 pixels×150 pixels, then, the image data for angle 300 also consists of 150 pixels×150 pixels. First, the angle information storage area 125 is created as a two-dimensional array of 150 pixels×150 pixels, and the angle characteristic and the angle characteristic strength are computed only for the 150 pixels×150 pixels. This is initial angle information 510. However, when a unit area is configured as 300 units×300 units, the angle characteristic and the angle characteristic strength should also be computed for the respective unit areas. Thus, the area of the angle information storage area 125 is expanded into the two-dimensional array of 300×300, and the angle information for the 300 pixels×300 pixels is re-computed based on the initial angle information 510. This is the re-computed angle information 530.

For emphasis, the angle characteristic strength is not calculated from the size adjusted image data for color 220. Instead, the initial angle information 510 is created from the image data for angle 300, which was directly copied from the original image data 100. Thus, the re-computed angle information 530 is created based on the initial angle information 510. With this, the unit area configuration and the angle characteristic strength of the configuration are computed. Then, line segments are determined based on the re-computed angle information 530 that has been re-computed for each pixel of the 300 pixels×300 pixels, and the line segment data 600 is created. When the pixel configuration of the original image data 100 matches the unit area configuration, there is no need of creating the re-computed angle information 530 from the initial angle information 510. Thus, the line segment data 600 is created from the initial angle information 510.

Next, the procedure for creating embroidery data 700 from original image data 100 is described with reference to FIG. 6. The procedure of a flowchart shown in FIG. 6 is carried out by running the embroidery data creation program in the CPU 101 of the embroidery data creation apparatus 1.

Figure 6:
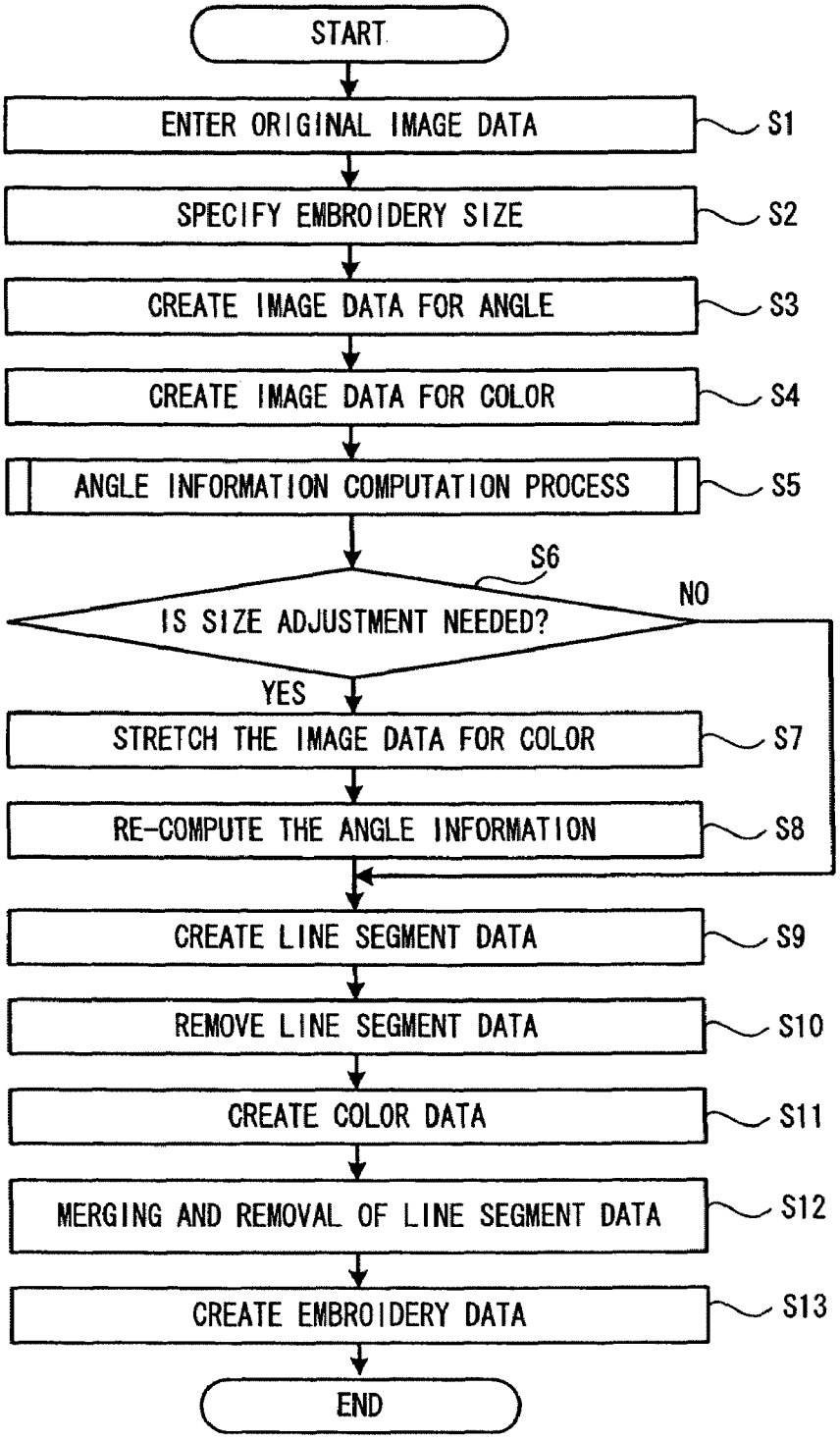
FIG. 6 is a flowchart showing a procedure of creating embroidery data from original image data.

As shown in FIG. 6, the original image data 100 for creating the embroidery data 700 is inputted (S1). The original image data 100 is inputted by operating the image scanner apparatus 25 to scan images or by specifying a file of image data stored in an external storage apparatus or the hard disk apparatus 120. Then, the original image data 100 is stored in the original image data storage area 121. The original image data 100 is comprised of a plurality of pixels, each pixel having information on hue that is an index of tint, brightness that is an index of lightness, chroma saturation that is an index of brilliance, etc. Then, respective pixels are arranged in a matrix, thus forming an image.

After the original image data 100 for creating the embroidery data 700 is inputted and stored in the original image data storage area 121 (S1), entry to specify embroidery size is accepted (S2). The entry may be made by having a user input vertical and horizontal length of embroidery or select from sizes registered in advance. Specified embroidery size is stored in an embroidery size storage area (not shown) provided in RAM 102. If embroidery data 700 of an embroidery sewing machine 3 in which embroidery size has been set in advance is created, the process of accepting entry of embroidery size is not carried out, and predefined size is stored in the embroidery size storage area.

Next, the image data for angle 300 is created from the original image data 100 and stored in the image data for angle storage area 123 (S3). To be specific, a copy of the original image data 100 is stored as the image data for angle 300 in the image data for angle storage area 123. Then, the copy of the original image data 100 is stored as the image data for color 200 in the image data for color storage area 122 (S4).

Figure 7:
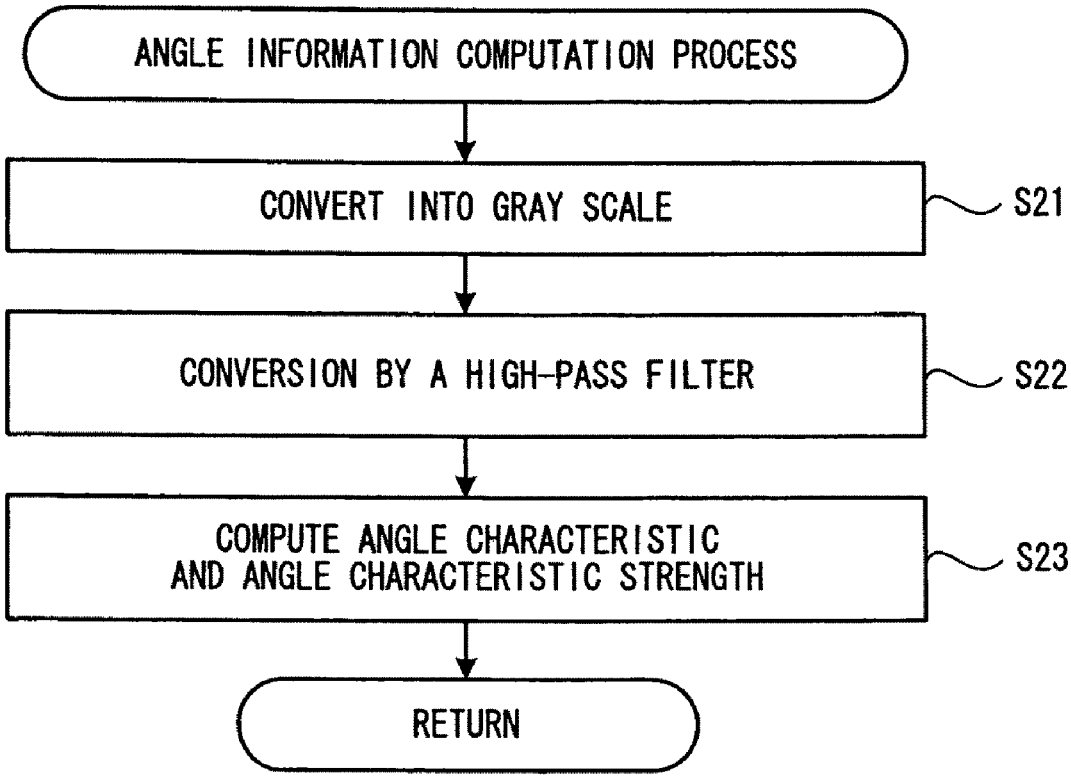
FIG. 7 is a flowchart of angle information computing process.
Figure 10:
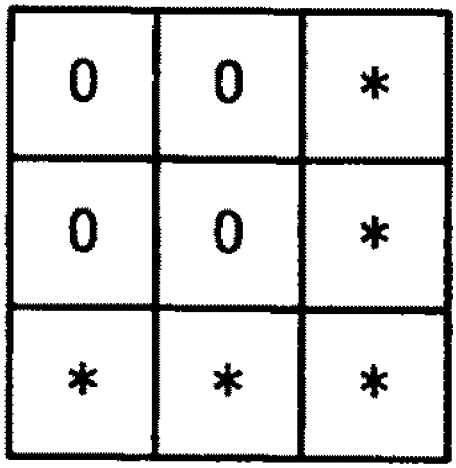
FIG. 10 is a schematic view showing a result of computation of an absolute value of a difference from pixel data in the lower right direction to each pixel.

Then, the angle characteristic and the angle characteristic strength of each pixel of the image data for angle 300 are computed, and the angle information 500 (initial angle information 510) is created (S5, see FIG. 7). Now, a method of computing the angle characteristic and the angle characteristic strength is described concretely with reference to FIG. 7 to FIG. 11.

First, inputted image data is converted into a gray scale (S21). This is a process of converting a color image into a monochrome image wherein among each pixel data (R, G, B) comprising image data consisting of components of three primary colors of RGB, one-half of a sum of maximum and minimum values is set as a luminance value being an index of lightness of that pixel. For instance, when RGB values of one pixel are (200, 100, 50), the luminance value will be (200+50)/2=125. A method of converting image data into a gray scale is not limited to the method described above, and for instance, a maximum value of the respective pixel data (R, G, B) can be set as a luminance value.

Next, in S21, conversion process by a well-known high-pass filter is conducted on the image data converted into the gray scale (S22). Then, the angle characteristic and the angle characteristic strength for each pixel comprising the image is computed based on the image converted by the high-pass filter that was obtained in S22 (S23). A specific method of computation is as described below. First, one pixel comprising an image is watched. The angle characteristic possessed by pixel data of that watched pixel is calculated, while referring to pixels of N dots surrounding the watched pixel. Now, for simplicity, the description is given for N=1. (N is a distance of the surrounding pixels from the watched pixel. In fact, for N=1, only the pixels adjacent to the watched pixels are referred. For N=2, not only the pixels to be referred adjacent to the watched pixel but also pixels surrounding them are referred.)

For instance, suppose that for 3×3 pixels centered around a watched pixel, each pixel data has luminance values as shown in a schematic view 590 of FIG. 8. Now, the luminance values are specified by numeric values ranging from 0 to 255, and when the luminance value is "0," the pixel is "black," when the luminance is 255, the pixel is "white." The luminance value of the watched pixel is "100," and the pixels surrounding it have the luminance value of "100," "50," "50," "50," "100," "200," "200," and "200" from the top left in the clockwise direction.

Figure 12:
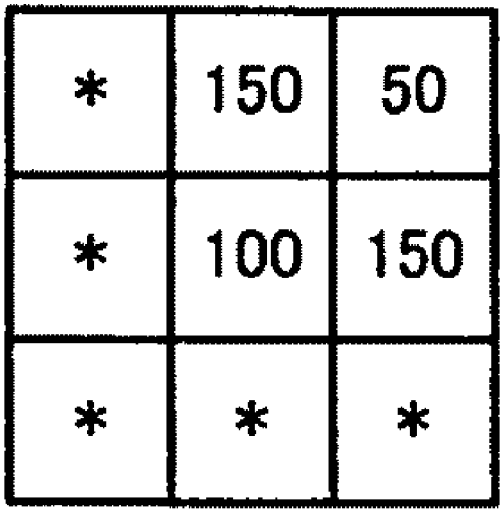
FIG. 12 is a schematic view showing a result of computation of an absolute value of a difference from pixel data in the lower left direction to each pixel.

First, for each pixel data, an absolute value of a difference from the pixel data in the right direction is respectively calculated. The result is a schematic view shown in the FIG. 9. In this case, for 3 pixels on the rightmost column, an absolute value is not calculated as they have no pixels to the right, thus "*" is shown. Then, as the watched pixel has the luminance value of "100" and the pixel to the right thereof has the luminance value of "50," the absolute value of the difference therebetween is "50." Next, the absolute value of the difference is similarly calculated for the pixels located in the lower right, down, and lower left directions. The results are shown in the schematic view 592 of FIG. 10, the schematic view 593 of FIG. 11 and the schematic view 594 of FIG. 12, respectively. For example, in FIG. 10, for each pixel value shown in the original FIG. 8, the absolute value of the difference for the pixel below and to the right is calculated. In FIG. 11, the absolute value of the difference for the pixel directly below is calculated. And finally, in FIG. 12, the absolute value of the difference of the pixel below and to the left is calculated. Based on the calculation results, "angle in a direction of a normal line of the angle characteristic" that corresponds to a direction in which the level of discontinuity of the pixel values in the area is high is determined. Then, an angle to be obtained by adding 90 degrees to the "angle in a direction of a normal line of the angle characteristic" shall be "angle characteristic" that is being determined.

To be specific, sums Tb, Tc, Td and Te of the respective calculation results are determined based on the calculation results in the respective directions. For example, the sum of all the values calculated in the right direction (FIG. 9) is assigned to Tb. All the values calculated in the lower right direction (FIG. 10) is Tc, down direction (FIG. 11) is Td, and lower left (FIG. 12) is Te. For the present example, those values would be: Tb=300, Tc=0, Td=300, and Te=450. Then, sums of horizontal components and vertical components are determined from the sums Tb, Tc, Td and Te, and an arc tangent is calculated. Then, it is believed that the horizontal/vertical components in the lower right direction counteract those in the lower left direction.

When the sum Tc in the lower right direction (direction of 45 degrees) is greater than the sum Te in the lower left direction (direction of 135 degrees) (Tc>Te), a resultant value that we wish to obtain is a value from 0 to 90 degrees. Thus, the lower right direction is considered + (positive) component in the horizontal/vertical components, while the lower left direction is considered − (negative) component in the horizontal/vertical components, thus a sum of the horizontal components being Tb+Tc−Te, and that of the vertical components being Td+Tc−Te.

On the contrary, when the sum Tc in the lower right direction is smaller than the sum Te in the lower left direction (Tc<Te), a resultant value that we wish to obtain is a value from 90 to 180 degrees. Thus, the lower left direction is considered + (positive) component in the horizontal/vertical components, while the upper left direction is considered − (negative) component in the horizontal/vertical components, thus a sum of the horizontal components being Tb−Tc+Te, and that of the vertical components being Td−Tc+Te. Then, as the resultant value we wish to obtain is a value from 90 to 180 degrees, the whole is multiplied by "−1" before the arc tangent is calculated.

For instance, in the case shown in FIG. 9 to FIG. 12, as Tc<Te, a resultant value we wish to obtain is a value from 90 to 180 degrees. A sum of horizontal components will be Tb−Tc+Te=300−0+450=750, while that of vertical components will be 300−0+450=750. Then, before an arc tangent is calculated, the whole is multiplied by −1, thus arctan being (−750/750)=−45 degrees. This angle is the "angle in a direction of a normal line of the angle characteristic" that is being determined. The angle computed as calculation result shows a direction in which the level of discontinuity of the image data in the watched area is high. Thus, the angle characteristic of the watched pixel in this case is −45+90=45 degrees. Then, since the lower right direction is now considered the positive components in the horizontal/vertical components, the 45 degrees obtained herein will be the lower right direction. In the above example, the angle characteristic can be determined by the difference in color information possessed by the pixels surrounding the watched pixel. In this case, although the luminance value corresponding to each pixel is used as color information, similar result can be obtained even if brilliance or tint is used.

In addition, the angle characteristic strength thus computed is calculated using the mathematical expression shown in the mathematical expression 1. In this case, as the sum of the differences is the sum of Tb, Tc, Td, and Te, (300+0+300+450)×(255−100)/255/16=39.9. Here the angle characteristic shows a direction of changing lightness, and the angle characteristic strength shows a magnitude of changing lightness.

$$\text{Angle characteristic strength}=\text{sum of difference}\times(255-\text{value of watched pixel})/(255\times(N\times 4)^2) \quad \text{[Mathematical Expression 1]}$$

In the embodiment, it is also possible to determine the angle characteristic and the strength thereof for each pixel comprising an image, by applying the angle characteristic and the strength thereof for each pixel comprising the image to the image data obtained by converting well-known Prewitt operator or Sobel operator into gray scale. For instance, when Sobel operator is used, assuming that in the coordinate (x, y), result of applying horizontal operator is sx and result of applying vertical operator is sy, the angle characteristic and the strength thereof in the coordinate (x, y) can be calculated with the mathematical expression shown in the mathematical expression 2.

$$\text{Angle characteristic}=\tan^{-1}(sy/sx)$$

$$\text{Angle characteristic strength}=\sqrt{(sx^2+sy^2)} \quad \text{[Mathematical Expression 2]}$$

As described above, the angle characteristic and the angle characteristic strength corresponding to each pixel of the image data for angle 300 are computed and stored as the initial angle information 510 in the angle information storage area 125 (FIG. 6, S5). Now, if size of the original image data 100 is 150 pixels×150 pixels, the angle characteristic and the angle characteristic strength are stored as an array of 150×150 in the angle information storage area 125.

After the initial angle information 510 is created in the process of FIG. 6 (S5), it is determined whether or not size adjustment is needed (S6). The pixel configuration of the original image data 100 is compared with the embroidery size stored in the embroidery size storage area of RAM 102 and the unit area configuration determined by the thread density. Now, if the unit area configuration is identical to the pixel configuration of the original image data 100, no size adjustment is needed (S6: NO) and the process proceeds to S9. The line segment data 600 is then created from the initial angle information 510 without expanding or reducing the image data for color 200 and without re-computing the angle information 500 (S9).

On the other hand, if the unit area configuration is not identical to the pixel configuration of the original image data 100, then the original image data 100 must be adjusted (S6: YES) through the well-known image scaling technique (S7). For instance, if the original image data 100 and the copied image data for color 210 consists of 150 pixels×150 pixels, and the unit area configuration is 300 units×300 units, the pixels are added and doubled by the well-known image expansion technique. If the original image data 100 and the copied image data for color 210 consist of 300 pixels×300 pixels, and the unit area configuration is 150 units×150 units, the pixels are removed and reduced to half.

Then, the angle information 500 is re-computed (S8). To be specific, the database containing the initial angle information 510, stored in the angle information storage area 125, must be adjusted to account for the adjusted size. If the original image data 100 was scaled down to accommodate the unit area configuration 500, then the database must be accordingly adjusted to contain angle information for the new size. Similarly, if the original image data 100 was scaled up to accommodate a larger unit area configuration 500, then the database must be increased to contain more angle information data.

Then, the angle characteristic and the angle characteristic strength corresponding to each pixel of the size adjusted image data for color 220 are computed. The re-computed angle information 530 after this re-computation is stored in the angle information storage area 125.

The re-computation process of the angle information 500 is described with reference to FIG. 13 to FIG. 26. Now, for a method of re-computation for expansion, a first expansion re-computing method, a second expansion re-computing method and a third expansion re-computing method are described. In addition, for a method of re-computation for reduction, a first reduction re-computing method, and a second reduction re-computing method is described. To re-compute for expansion or reduction, respectively, any of the method may be used.

The first expansion re-computing method is described with reference to FIG. 13 to FIG. 15, in which embroidery data 700 having unit area configuration of 300 units×300 units is created from the original image data 100 consisting of 150 pixels×150 pixels.

As the original image data 100 consists of 150 pixels×150 pixels, corresponding to each pixel, angle characteristic strength is stored in the vertical columns of 1 to 150 and the horizontal columns of 1 to 150 in the initial angle information 510, as shown in FIG. 13. In reference to the database containing the initial angle information, the shorthand "initial angle information (1,2)" is used to indicate the initial angle information stored in the first column and second row. Similarly, "re-computed angle information (1,2)" will be used to indicate the re-computed angle information stored in the first column and second row. Now, for simplicity, the description focuses on the angle characteristic strength of the initial angle information (1,1), (1,2), (2,1), (2,2). The initial angle information (1,1)=10, the initial angle information (1,2)=15, the initial angle information (2,1)=80, and the initial angle information (2,2)=100.

In order to match the initial angle information 510 created from the original image data 100 of 150 pixels×150 pixels to the embroidery data 700 of 300 units×300 units, it is necessary to double elements of the arrays. Thus, as shown in FIG. 14, they are expanded to the vertical columns of 1 to 300 and the horizontal columns of 1 to 300. To be specific, the initial angle information (1,1) shall be the re-computed angle information (1,1) and the re-computed angle information (1,2), (2,1), (2,2) are added; the initial angle information (1,2) shall be the re-computed angle information (1,3) and the re-computed angle information (1,4), (2,3), (2,4) are added; the initial angle information (2,1) shall be the re-computed angle information (3,1) and the re-computed angle information (3,2), (4,1), (4,2) are added; the initial angle information (2,2) shall be the re-computed angle information (3,3) and the re-computed angle information (3,4), (4,3), (4,4) are added.

In the first expansion computing method, values of array elements corresponding to added pixels shall be identical to those of array elements corresponding to an original pixel from which addition was made. Thus, as shown in FIG. 15, "10" that is the same value as that of the initial angle information (1,1) is stored in the re-computed angle information (1,2), (2,1) and (2,2) that were added to the initial angle information (1,1). Then, "15" that is the same value as that of the initial angle information (1,2) is stored in the re-computed angle information (1,4), (2,3) and (2,4) that were added to the initial angle information (1,2). Then, "80" that is the same value as the initial angle information (2,1) is stored in the re-computed angle information (3,2), (4,1) and (4,2) that were added to the initial angle information (2,1). Then, "100" that is the same value as the initial angle information (2,2) is stored in the re-computed angle information (3,4), (4,3) and (4,4) that were added to the initial angle information (2,2). Similarly, for the angle characteristic of the angle information, the values in the angle characteristic columns of the arrays corresponding to the added pixels in the re-computed angle information 530 shall be identical to those of the angle characteristic columns of arrays corresponding to the original pixel from which addition was made in the initial angle information 510.

A similar process is also done on other pixels, the re-computed angle information 530 is created from the initial angle information 510 by making values of added pixels identical to that of an original pixel, and the angle characteristic strength and the angle characteristic having the same configuration as that of the unit area of the embroidery data 700 are determined.

The second expansion computing method is described with reference to FIG. 13, FIG. 14, and FIG. 16. Assuming the same case in which embroidery data 700 of 300 units×300 units is created from original image data 100 consisting of 150 pixels×150 pixels. Just as in the first expansion computing method, the array of the initial angle information 510 of 150 units×150 units as shown in FIG. 13 is expanded to the array of the re-computed angle information 520 of 300 units× 300 units as shown in FIG. 14. In the second expansion computing method, all values of the array elements corresponding to the pixels that were added (added pixels) shall be "0," as shown in FIG. 16. The similar process is also done on other pixels, the re-computed angle information 530 is created from the initial angle information 510 by setting all the values of the added pixels to "0," and the angle characteristic strength having the same configuration as that of the unit area of the embroidery data 700 is determined. In addition, for the angle characteristic of the angle information, since the values of the angle characteristic strength of the added pixels shall be "0," there will be no effect when the line segment data 600 is created, whatever angle the angle characteristic has. Thus, the angle characteristic of the added pixels shall not be set. For instance, the initial value of "0" is stored in the angle characteristic columns of the arrays corresponding to the added pixels of the re-computation information.

However, in this method, if the rate of expansion from the copied image data for color 210 to the size adjusted image data for color 220 is approximately double, the original pixels will surround the added pixels set to "0," and thus the pixels having the angle characteristic strength not equal to "0" will exist. Thus, significant line segment data 600 is obtained and significant embroidery data 700 can be computed. If the rate of expansion is even greater, such as three or four times, there will be no pixels having the angle characteristic strength of not being "0" surrounding the added pixels. Thus, neither significant line segment data 600 nor significant embroidery data 700 can be computed. Hence, in this second expansion computing method, it is desirable that the rate of expansion is less than 300 percent.

Next, the third expansion computing method is described with reference to FIG. 17 to FIG. 20. Suppose the case in which embroidery data 700 of 300 units×300 units is created from original image data of 200 pixels×200 pixels.

As the original image data consists of 200 pixels×200 pixels, corresponding to each pixel, the angle characteristic strength is stored in the vertical columns of 1 to 200 and the horizontal columns of 1 to 200 in the initial angle information 510, as shown in FIG. 17. In reference to the database containing the initial angle information, the shorthand "initial angle information (1,2)" is used to indicate the initial angle information stored in the first column and second row. Similarly, "re-computed angle information (1,2)" will be used to indicate the re-computed angle information stored in the first column and second row. For simplicity, the description focuses on the angle characteristic strength of the initial angle information (1,1), (1,2), (2,1), (2,2). The initial angle information (1,1)=10, the initial angle information (1,2)=15, the initial angle information (2,1)=80, and the initial angle information (2,2)=100.

In the third expansion computing method, a calculation process array of 600 units×600 units is created by tripling the initial angle information 513, and values corresponding to added pixels shall be identical to those corresponding to the original pixels. To calculate the size of the adjusted database, the least common multiple between the original image data 100 and the units of embroidery data 700 is found. In the case at hand, the least common multiple of 200 and 300 is 600. Thus, the size of the adjusted database is set to 600×600, as shown by FIG. 18.

In FIG. 18, "10" is stored in the calculation process array (1,1) corresponding to the initial angle information (1,1), and "10" is stored in the calculation process arrays (1,2), (1,3), (2,1), (2,2), (2,3), (3,1), (3,2) and (3,3) that were added to the initial angle information (1,1). Then, "15" is stored in the calculation process array (1,4) corresponding to the initial angle information (1,2) and "15" that is identical to the value of the initial angle information (1,2) is stored in the calculation process arrays (1,5), (1,6), (2,4), (2,5), (2,6), (3,4), (3,5) and (3,6) that were added to the initial angle information (1,2). Then, "80" is stored in the calculation process array (4,1) corresponding to the initial angle information (2,1), and "80" that is identical to the value of the initial angle information (2,1) is stored in the calculation process arrays (4,2), (4,3), (5,1), (5,2), (5,3), (6,1), (6,2) and (6,3) that were added to the initial angle information (2,1). Then, "100" is stored in the calculation process array (4,4) corresponding to the initial angle information (2,2), and "100" that is identical to the initial angle information (2,2) is stored in the calculation process arrays (4,5), (4,6), (5,4), (5,5), (5,6), (6,4), (6,5) and (6,6) that were added to the initial angle information (2,2). In addition, similarly for the angle characteristic of the angle information, the values of the angle characteristic columns of the arrays corresponding to the added pixels in the re-computation angle information 530 shall be identical to the values in the angle characteristic columns of the arrays corresponding to the original pixels from which addition was made in the initial angle information 510.

The array of 6 units×6 units, as shown in FIG. 18, which is a collection of four groups of 3 units×3 units can also be viewed as a collection of nine groups of 2 units×2 units, as shown in FIG. 19. Another way of looking at it is that the database of 600×600 units is actually made up of 300×300 units, wherein each of the 300×300 units is made up of a small array of 2×2 units. As shown in FIG. 20, the recomputed angle information 530 shall be the array of 300 units×300 units that corresponds to the size of the embroidery data 700. Thus, an average of the respective elements of the 2×2 arrays is determined and stored in the corresponding elements in the calculation process array. To be specific, an average of respective elements of the values stored in (1,1), (1,2), (2,1) and (2,2) is determined "(10+10+10+10)/4=10," and stored in the re-computed angle information (1,1). In addition, although any value is rounded after the decimal point, in this embodiment, the rounding is not limited to the fractional part, but may take place at the first decimal place or lower or the value may be truncated.

Thus, an average of the respective elements of the calculation process arrays (1,3), (1,4), (2,3) and (2,4) is determined "(10+15+10+15)/4=13," and stored in the re-computed angle information (1,2). Then, an average of respective elements of the calculation process arrays (1,5), (1,6), (2,5) and (2,6) is determined "(15+15+15+15)/4=15," and stored in the re-computed angle information (1,3). Then, an average of respective calculation process arrays (3,1), (3,2), (4,1) and (4,2) is determined "(10+10+80+80)/4=45," and stored in the re-computed angle information (2,1). Then an average of the calculation process arrays (3,3), (3,4), (4,3) and (4,4) is determined "(10+15+80+100)/4=51," and stored in the re-computed angle information (2,2). Then an average of respective elements of the calculation process arrays (3,5), (3,6), (4,5) and (4,6) is determined "(15+15+100+100)/4=58," and stored in the re-computed angle information (2,3). Then, an average of respective elements of the calculation process arrays (5,1), (5,2), (6,1) and (6,2) is determined "(80+80+80+80)/4=80," and stored in the re-computed angle information (3,1).

Then, an average of respective elements of the calculation process arrays (5,3), (5,4), (6,3) and (6,4) is determined "(80+100+80+100)/4=90," and stored in the re-computed angle information (3,2). Then, an average of respective elements of the calculation process arrays (5,5), (5,6), (6,5) and (6,6) is determined "(100+100+100+100)/4=100," and stored in the re-computed angle information (3,3).

The angle characteristic of the angle information is calculated as described below. To be specific, with the angle characteristic $\theta$ and the angle characteristic strength $\alpha$ of one pixel in the calculation process array, "$X=\cos(\theta)\times\alpha$" and "$Y=\sin(\theta)\Delta\alpha$" are calculated for all pixels. Then, a sum of X (Xsum) and that of Y (Ysum) are determined for a collection of arrays of 2 units×2 units. Then, an arc tangent is obtained from the determined Xsum and Ysum. This "a tan (Ysum/Xsum)" shall be the angle characteristic of respective pixels of the re-computed angle information.

For instance, for the angle characteristic, if it is assumed that the initial angle information (1,1)=45, the initial angle information (1,2)=30, the initial angle information (2,1)=50, and the initial angle information (2,2)=15, these angle characteristics are stored in the respective corresponding arrays of the calculation process array. In fact, the calculation process array (3,3)=45, the calculation process array (3,4)=30, the calculation process array (4,3)=50, and the calculation process array (4,4)=15. Making these four arrays into a collection of arrays of 2 units×2 units, "Xsum=cos(45)×10+cos(30)×15+cos(50)×80+cos(15)×100≈168" and "Ysum=sin(45)×10+sin(30)×15+sin(50)×80+sin(15)×100≈102." Then, it will be "a tan (Ysum/Xsum)≈31." The "31" is stored as the angle characteristic in the re-computed angle information (1,1). The fractional parts have been rounded.

A similar process is also done on other pixels such that the re-computed angle information 530 is created from the initial angle information 510 based on values of surrounding pixels, and the angle characteristic strength and the angle characteristic having the same configuration as that of the unit area of the embroidery data 700 are determined.

Next, a first reduction computing method is described with reference to FIG. 21 and FIG. 22. Suppose a case in which embroidery data 700 of 300 units×300 units is created from original image data of 600 pixels×600 pixels.

As the original image data 100 consists of 600 pixels×600 pixels, corresponding to each pixel, the angle characteristic strength is stored in the vertical columns of 1 to 600 and the horizontal rows of 1 to 600, as shown in FIG. 21. Now, for simplicity, the description focuses on the 16 array elements of the initial angle information (1,1), (1,2), (1,3), (1,4), (2,1), (2,2), (2,3), (2,4), (3,1), (3,2), (3,3), (3,4), (4,1), (4,2), (4,3) and (4,4). The initial angle information (1,1)=10, the initial angle information (1,2)=10, the initial angle information (1,3)=15, and the initial angle information (1,4)=15, the initial angle information (2,1)=10, the initial angle information (2,2)=10, the initial angle information (2,3)=15, the initial angle information (2,4)=15, the initial angle information (3,1)=80, the initial angle information (3,2)=80, the initial angle information (3,3)=100, the initial angle information (3,4)=100, the initial angle information (4,1)=80, the initial angle information (4,2)=80, the initial angle information (4,3)=100, and the initial angle information (4,4)=100.

Since the re-computed angle information 530 is created by reducing initial angle information 510 to one-half, in the first reduction computing method, array elements of 2 units×2 units of the initial angle information 516 is considered a collection. Thus, each group of 2 units×2 units in the initial angle information 516 shall make up the 300 units×300 units. In the example of FIG. 21, as all values of the elements in the collection of 2 units×2 units have the same value, the values shall be values of the corresponding array elements of the re-computed angle information. To be specific, all of the values of the elements in the initial angle information (1,1), (1,2), (2,1), and (2,2) are "110" which is then stored in the re-computed angle information (1,1). Then, all the values of the elements in the initial angle information (1,3), (1,4), (2,3) and (2,4) are "15" which is then stored in the re-computed angle information (1,2). Then, all the values of the elements in the initial angle information (3,1), (3,2), (4,1) and (4,2) are "80" which is then stored in the re-computed angle information (2,1). Then, all the values of the elements in the initial angle information (3,3), (3,4), (4,3) and (4,4) are "100," which is then stored in the re-computed angle information (2,2).

Since the values of the elements in the collections of 2 units×2 units are all the same in this embodiment, the values of the re-computed angle information are set to the same value as that of the initial angle information. If all the values of the elements in the collections are not exactly the same, an average, a maximum, or minimum value of the values in the collections may be taken. In this example, a collection of elements consists of 2 units×2 units because the re-computed angle information 530 was created by reducing the initial angle information 510 to one-half. However, if it was reduced to one-third, a collection of 3 units×3 units may be considered. Thus, the number of units consisting of a collection may be determined depending on the reduction ratio.

The similar process is also done on other pixels, the re-computed angle information 530 is created based on values of surrounding pixels from the initial angle information 510, and the angle characteristic strength having the same configuration as that of the unit area of embroidery data 700 is determined.

For the second reduction computing method, suppose the case in which embroidery data 700 of 200 units×200 units is created from original image data 100 of 300 pixels×300 pixels.

As the original image data 100 consists of 300 pixels×300 pixels, the angle characteristic strength is stored in the vertical columns of 1 to 300 and the horizontal rows of 1 to 300 as shown in FIG. 21. Now, for simplicity, the description focuses on the 9 elements of the initial angle information (1,1), (1,2), (1,3), (2,1), (2,2), (2,3), (3,1), (3,2) and (3,3). The initial angle information (1,1)=10, the initial angle information (1,2)=89, the initial angle information (1,3)=15, and the initial angle information (2,1)=63, the initial angle information (2,2)=37, the initial angle information (2,3)=25, the initial angle information (3,1)=80, the initial angle information (3,2)=4, and the initial angle information (3,3)=100.

First, a calculation process array of 600 units×600 units is created by doubling the initial angle information 513. Then, the values of the arrays corresponding to the added pixels shall be made identical to values of the array corresponding to the original pixel. Now, the reason for making the calculation process array 600×600 is that the least common multiple of 300 units of the original image data 100 and 200 units of the embroidery data 700 is 600. The schematic view 527 of FIG. 24 shows this state.

As shown in FIG. 24, "10" is stored in the re-computed angle information (1,1) corresponding to the initial angle information (1,1), and the value "10" that is identical to the initial angle information (1,1) is stored in the calculation process arrays (1,2), (2,1) and (2,2) added to the initial angle information (1,1). Then, "89" is stored in the calculation process array (1,3) corresponding to the initial angle information (1,2), and the value "89" that is identical to the initial angle information (1,2) is stored in the calculation process arrays (1,4), (2,3) and (2,4) added to the initial angle information (1,2). Then, "15" is stored in the calculation process array (1,5) corresponding to the initial angle information (1,3), and the value "15" that is identical to the initial angle information (1,2) is stored in the calculation process arrays (1,6), (2,5) and (2,6) added to the initial angle information (1,3).

Then, "63" is stored in the calculation process array (3,1) corresponding to the initial angle information (2,1), and the value "63" that is identical to the initial angle information (2,1) is stored in the calculation process arrays (3,2), (4,1), and (4,2) added to the initial angle information (2,1). Then, "37" is stored in the calculation process array (3,3) corresponding to the initial angle information (2,2), and the value "37" that is identical to the initial angle information (2,2) is stored in the calculation process arrays (3,4), (4,3), and (4,4) added to the initial angle information (2,2). Then, "25" is stored in the calculation process array (3,5) corresponding to the initial angle information (2,3), and the value "25" that is identical to the initial angle information (1,2) is stored in the calculation process arrays (3,6), (4,5) and (4,6) added to the initial angle information (2,3).

Then, "80" is stored in the calculation process array (5,1) corresponding to the initial angle information (3,1), and the value "80" that is identical to the initial angle information (2,1) is stored in the calculation process arrays (5,2), (6,1) and (6,2) added to the initial angle information (3,1). Then, "4" is stored in the calculation process array (5,3) corresponding to the initial angle information (3,2), and the value "4" that is identical to the initial angle information (2,2) is stored in the calculation process arrays (5,4), (6,3) and (6,4) added to the initial angle information (3,2). Then, "100" is stored in the calculation process array (5,5) corresponding to the initial angle information (3,3), and the value "100" that is identical to the initial angle information (1,2) is stored in the calculation process arrays (5,6), (6,5) and (6,6) added to the initial angle information (3,3).

The group of 6 units×6 units, as shown in FIG. 24, is a collection of nine groups of 2 units×2 units stacked by 3×3, as shown in FIG. 25. The 600×600 calculation database is thus made up of 200×200 units in which each unit comprises a mini array of 3×3 units. In addition, as shown in FIG. 26, the recomputed angle information 530 shall be the array of 200 units×200 units that has the same size as the embroidery data 700. An average of respective elements of the collection of arrays of 3 units×3 units of the calculation process array is determined and stored in the corresponding elements in the calculation process array. To be specific, an average of respective elements of the calculation process arrays (1,1), (1,2), (1,3), (2,1), (2,2), (2,3), (3,1), (3,2) and (3,3) is determined "(10+10+89+10+10+89+63+63+37)/9=42," and stored in the re-computed angle information (1,1). In addition, the fractional part shall be rounded in this embodiment.

Then, an average of respective elements of the calculation process arrays (1,4), (1,5), (1,6), (2,4), (2,5), (2,6), (3,4), (3,5) and (3,6) is determined "(89+15+15+89+15+15+37+25+25)/9=36," and stored in the re-computed angle information (1,2). Then, an average of respective elements of the calculation process arrays (4,1), (4,2), (4,3), (5,1), (5,2), (5,3), (6,1), (6,2) and (6,3) is determined "(63+63+37+80+80+4+80+80+4)/9=46," and stored in the re-computed angle information (2,1). Then, an average of respective elements of the calculation process arrays (4,4), (4,5), (4,6), (5,4), (5,5), (5,6), (6,4), (6,5) and (6,6) is determined "(37+25+25+4+100+100+4+100+100)/9=55" and stored in the re-computed angle information (2,2). As described above, the angle characteristic strength having the same configuration as that of the unit area of the embroidery data 700 is determined. In addition, the angle characteristic is determined with the calculation method similar to the third expansion computing method on a collection of 3 units×3 units arrays, and stored in the angle characteristic column of the corresponding array in the re-computed angle information.

A similar process is also done on the other pixels, the re-computed angle information 530 is created based on values of surrounding pixels from the initial angle information 510, and the angle characteristic strength and the angle characteristic having the same configuration as that of the unit area of the embroidery data 700 are determined.

As described above, when it is determined at S6 in FIG. 6 that size adjustment is needed because the unit area configuration is not identical to the pixel configuration of the original image data 100 (S6: YES), the angle information 500 is re-computed after the image data for color 200 is stretched (S7), and the re-computed angle information 530 matching the unit area configuration of the embroidery data 700 is stored in the angle information storage area 125 (S8).

Figure 27:
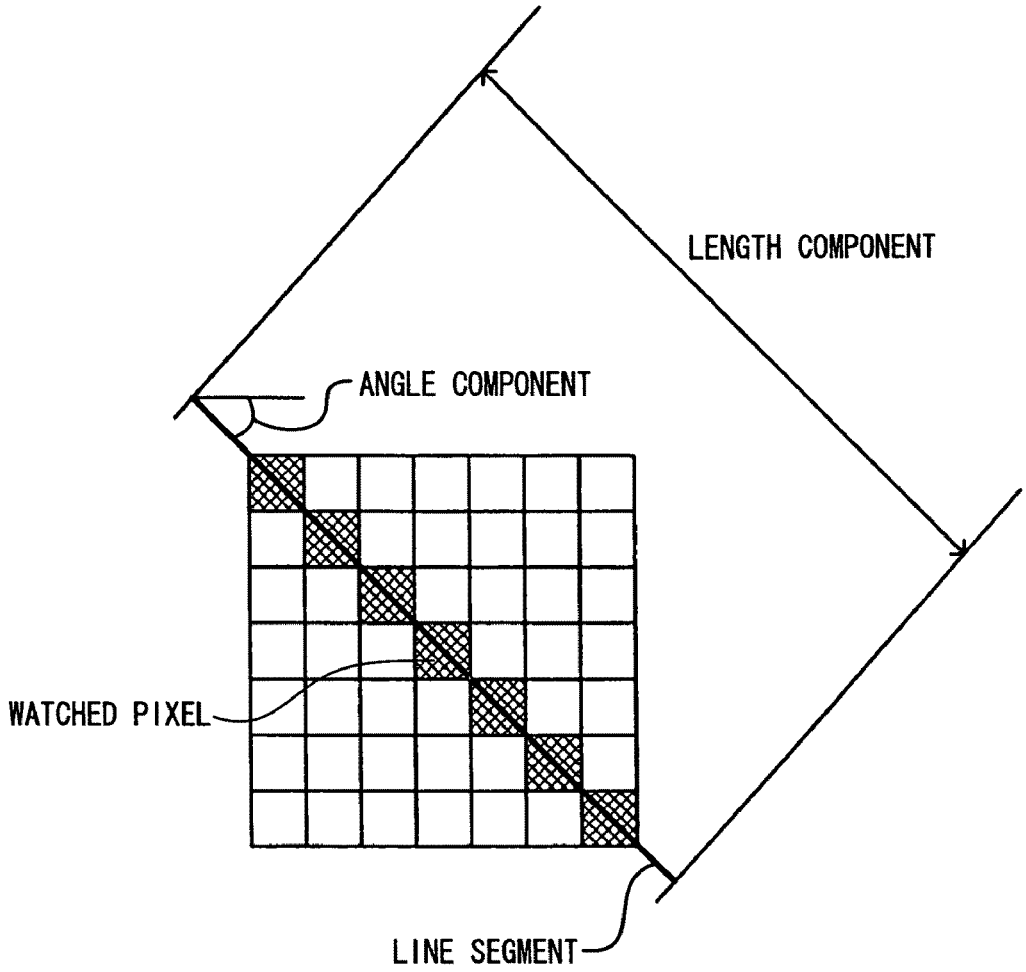
FIG. 27 is a schematic view showing a relationship between pixels and line segments when an angle component is 45 degrees.

Next, line segment data 600 will be created from the re-computed angle information 530 stored in the angle information storage area 125, and stored in the line segment data storage area 126 (S9). Line segment information having an angle component and a length component is first created for each pixel. A set of the line segment information created from the angle information 500 shall be the line segment data 600. A preset fixed value or an input value entered by a user shall be set to the length component, while the angle characteristic stored in the re-computed angle information 530 that has been stored in the angle information storage area 125 shall be directly set to the angle component. To be specific, as shown in FIG. 27, line segment information enabling the line segments having the set angle components and length components to be arranged around the watched pixel is created. Note that FIG. 27 shows the case in which the angle component is 45 degrees.

If line segment information is created for all pixels comprising an image, and embroidery is done according to the embroidery data 700 that is created based on the line segment data 600, not only will the sewing quality be impaired (because there are too many stitches or the same part is sewn repeatedly), but also embroidery data 700 will be created that does not effectively reflect characteristics, as a whole image, because the line segment information is created uniformly even for pixels having a small angle characteristic strength. Thus, respective pixels comprising the image are scanned sequentially from left to right and from top to bottom and the line segment information will be created only when the angle characteristic strength of the pixel is greater than a threshold. As a "threshold of the angle characteristic strength," a preset fixed value or an input value entered by the user shall be set.

Next, for pixels whose angle characteristic strengths are lower than a predetermined threshold and that do not overlap with line segments identified by already created line segment information, the line segment information is created as described below. First, pixels surrounding a watched pixel are scanned, and for pixels whose angle characteristics strength is higher than the threshold, a sum T1 of cosine value of the angle characteristic and a product of angle characteristic strengths and a sum T2 of sine value of the angle characteristic and a product of angle characteristic strengths are determined, respectively. Then, with an arc tangent value of T2/T1 as a new angle characteristic, the angle component is determined, and the line segment data having the length component mentioned above is created. For any pixels having a small angle characteristic strength, as it is hard to say that the angle characteristic is accurately reflected in the line segment data as described above, embroidery data 700 capable of reproducing a comfortable image by creating the line segment information based on the new angle characteristic that has been computed by taking into consideration the angle characteristics of the surrounding pixels is created.

When the line segment data 600 is thus created (S9), the line segment information of the line segment that is inappropriate or unnecessary in subsequent creation of embroidery data 700 is removed from the line segment data 600 that has been stored in the line segment data storage area 126 (S10). To be specific, all pixels comprising an image are scanned in order from upper left, and the following process is performed on all the pixels for which the line segment information has been created.

First, around a watched pixel, all pixels existing in a predetermined range on an extended line of line segments specified by line segment information created for the watched pixel are scanned. If any pixel that has angle characteristic approximate to that of the watched pixel and whose angle characteristic strength is lower than that of the watched pixel exists, the line segment information created for that pixel is removed. On the contrary, if any pixel that has angle characteristic approximate to that of the watched pixel and yet whose angle characteristic strength is higher than that of the watched pixel exists, the line segment information created for the watched pixel is removed. Now, for an "n value" that determines a range of scanning or the approximate range "±θ" of the angle characteristic, a preset fixed value or an input value entered by a user may be adopted, although the range of scanning shall be the range obtained by multiplying by n times the length component of the line segment information created for the watched pixel.

When the unnecessary line segment information is thus removed (S10), color data 400 is created for each line segment (S11). When the color data 400 is created, size adjusted image data for color 220 is used. However, if size adjustment does not take place, copied image data for color 210 is used. The sized adjusted image data for color 220 is used in the following description.

When a color component is determined, a color of embroidery thread to be used should be set. To set this, the number of embroidery thread colors to be used, thread color information (RGB values), and embroidery thread color code for the number of the thread colors shall be entered. Then, a thread color correspondence table is created based on the entry and the thread color sewing order is also set. In addition, embroidery thread colors and the thread color sewing order may be preset or set by a user according to the input screen. Also, the user may select thread colors to be used from the thread color correspondence table that has been created in advance.

First, reflection reference level for determining a scope of reference to colors in the size adjusted image data for color 220 is set. One example of the reference scope is an area surrounded by two parallel lines that sandwich a line segment and two perpendicular lines to both ends of the line segment. Then, the reflection reference level shall be the amount of distance from the line segment identified by the line segment information to the parallel lines (e.g., number of pixels or length of embroidery result). In order to draw the line segment, an image having the same size as the size adjusted image data for color 220 is created as a converted image in the converged image storage area (not shown) in RAM 102. In addition, the scope of reference to a color of the size adjusted image data for color may be preset or entered by the user.

Next, when the line segment identified by the line segment information, created for a watched pixel, is drawn on a converted image the reference area is determined and a sum Cs1 of respective RIG/B values is determined for all pixels contained in this reference area. The number of pixels used to compute the sum Cs1 shall be d1. A pixel is not included in the calculation if no line segments pass over the particular pixel or if the pixel is already accounted for in the calculation of a different line segment.

For a corresponding reference area of the size adjusted image data for color 220, a sum of respective R/G/B values Cs2 is determined for all pixels contained in the reference area. The number of pixels in the reference area shall be d2.

Then, the number of pixels of a line segment that will be drawn from now shall be s1, and thus the color CL that will be (Cs1+CL×s1)/(s1+d1)=Cs2/d2 is computed. This means that when a color CL is set to a line segment that will be drawn from now, an average of colors of line segments in that reference area will be equal to an average of colors in a corresponding reference area of an original image.

Lastly, among thread colors entered, a thread color with the closest distance to the line segment color CL in the RGB space is determined, and is stored as a color component of the line segment in the color data storage area 124. In addition, a distance d in the RGB space is computed based on the mathematical expression shown in [Mathematical Expression 3], assuming that the RGB values of the computed color CL are r0, g0, and b0 and that those of the entered thread color are rn, gn, and bn.

$$d=\sqrt{(rO-rn)^2+(gO-gn)^2+(bO-bn)^2} \quad \text{[Mathematical Expression 3]}$$

When the color data 400 is thus created, each line segment information is analyzed again with the color components included, and merging or removal of the line segment information takes place in the line segment data 600 (S12). First, among line segments identified by respective line segment data, if there exist line segments of a same color and which overlap on the same line. In other words, there exist more than one line segment having identical angle and identical color components and which partially overlap, the data for those line segments is merged into data for a single line segment. Thus, since the number of stitches can be reduced finally by merging data for more than one line segment into that for one line segment, it is possible to create embroidery data that can efficiently do embroidery and sew without compromising the sewing quality.

When the line segments are arranged according to the sewing order that has been set in S5, if a line segment having a certain color component may be partially masked by a line segment having another color component and to be arranged later, in which case an expressive ratio of that line segment being masked by the line segment that has other color component is computed. If there exists any line segment whose expressive ratio is lower than a predetermined threshold (the lowest expressive ratio), that line segment data is removed. Since the number of final stitches can be reduced by removing data of line segments having a low expressive ratio and less significance, it is possible to create embroidery data that can efficiently do embroidery and sew without compromising the sewing quality. In addition, a preset fixed value or an input value entered by a user may be adopted as a threshold (the lowest expressive ratio).

The embroidery data 700 is created on the basis of the line segment data 600 and the color data 400 that are created for a plurality of pixels comprising an image, as described above (S13). Basically, creation of the embroidery data based on the line segment data 600 and the color data 400 is performed by converting, for every component of a same color, a starting point, a terminal point and a color component that are identified by data for respective line segments into a starting point, a terminal point and a color of a stitch. However, if line segments are all converted into independent stitches, jump stitch places occur as many as the number of the line segments. Moreover, each of the jump stitch places may need a reinforcement stitch, thus damaging the sewing quality. Thus, the following process is performed to convert as many respective line segments into continuous stitches as possible.

First, a group of line segments are divided into a group of line segments for each color component. Next, for a group of line segments of a given color component, a line segment having an endpoint located at the top leftmost position is searched, making the endpoint a starting point of the line segment (start line segment) and another endpoint of the line segment a terminal point. Then, another line segment having an endpoint close to the terminal point is searched, making the endpoint a starting point of a next line segment and the other endpoint of the line segment a terminal point. Through repetition of this process, the sewing order is determined for the group of line segments for a particular color component. This is repeated for the group of line segments of all color components. Needless to say, when the process is performed, the line segments for which the order has already been determined will be excluded from searching in determining the subsequent order.

The embroidery data 700 is created from the original image data 100, as described above. To create embroidery data 700 tailored to an embroidery size, the number of pixels needed for creating the embroidery data 700 based on embroidery thread density and embroidery size is calculated. Copied image data for color 210 that is a direct copy of original image data 100 is stretched into size adjusted image data for color 220 that is image data having the number of pixels needed for creation of the embroidery data 700. However, if the size adjusted image data for color 220 is an image that has been expanded from the copied image data for color 210, the size adjusted image data for color 220 is more blurred as a whole than the copied image data for color 210. Similarly, if the size adjusted image data for color 220 is an image that has been reduced from the copied image data for color 210, details of the former (the size adjusted image data for color 220) may be lost in the scaling-down process. Thus, if the angle information 500 is created based on the size adjusted image data for color 220, the angle characteristic strength is low when an image is expanded as a whole, while the angle characteristic strength is higher as a whole when the image is reduced.

Thus, due to the detrimental effect of the scaling process on the calculation of angle characteristic, the initial angle information 510 is first created from the image data for angle 300, as first mentioned above with respect to step S5. Then, angle information of pixel configuration necessary for creation of the embroidery data 700 is re-computed based on the initial angle information 510, and the re-computed angle information 530 is created. The line segment data 600 is created from the re-computed angle information 530. The color data 400 is created from the size adjusted image data for color 220 and the line segment data 600. The embroidery data 700 is created from the line segment data 600 and the color data 400.

Thus, even when scaling up an image for the size adjusted image data for color 220, the angle characteristic strength is not adversely affected. Similarly, the sewn condition will not be more blurred by the scaling up of an image, and thus, the final sewn product looks closer to the original image data 100.

In addition, it is needless to say that an embroidery data creation apparatus, and a recording medium that records the embroidery data creation program of the present disclosure shall not be limited to the embodiments described above, but various modifications may be made without deviating from the summary of the present disclosure.

In the above embodiment, in the angle information re-computation process (S8) shown in FIG. 6, the first, second, and third expansion re-computing methods are described as a computing method in the case of expansion, while the first and second reduction re-computing methods are described for the re-computation method in the case of reduction, and any of the expansion/reduction methods may be used. However, a particular embodiment need not be limited to one scaling-up and scaling-down method. An embodiment may incorporate all methods and enable the user to select the preferred method. As a selection method, a setting screen in which a calculation method is set is provided, a storage area for storing the setting information is provided in the hard disk apparatus 120, values showing calculation methods to be used are stored, and the value may be read to calculate with a specified calculation method. In addition, a calculation method may be specified every time this process is performed.

Figure 28:
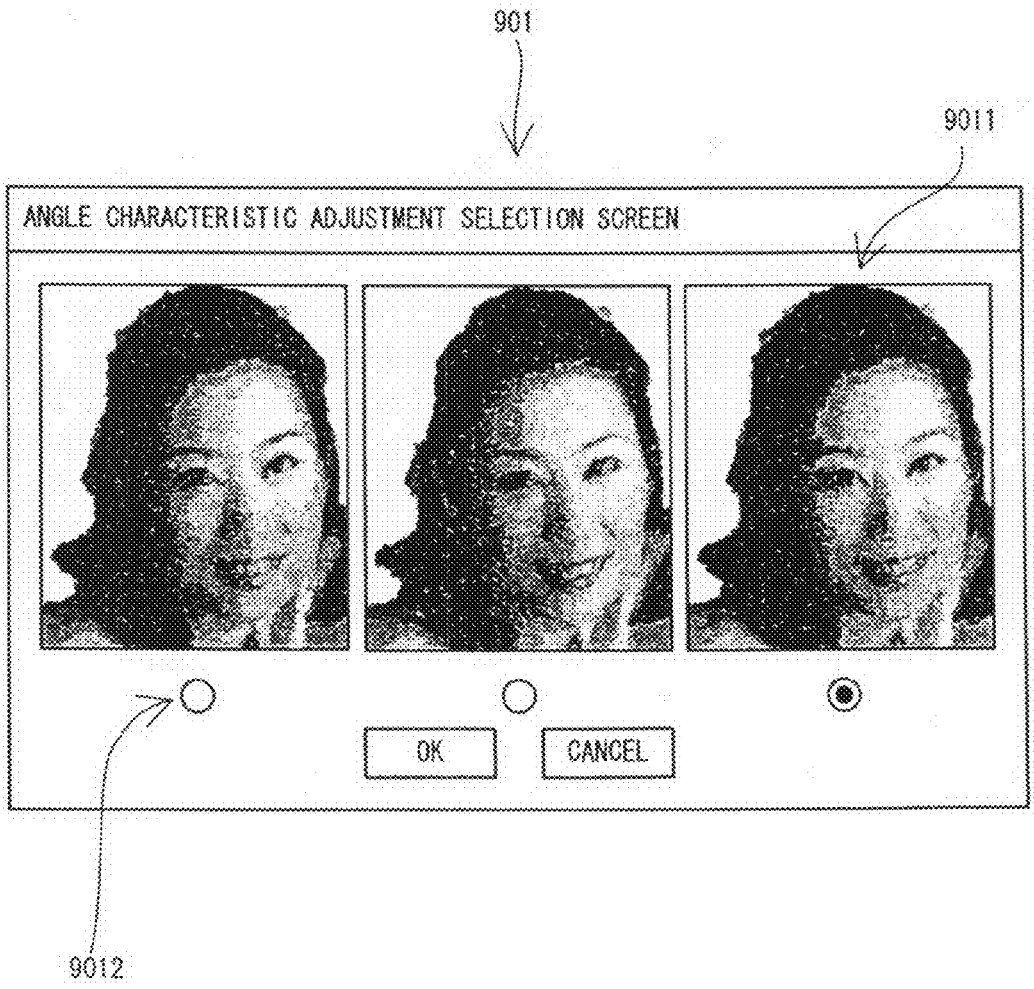
FIG. 28 is a view of angle characteristic adjustment selection screen.

Preview screens of finished embroidery products are created by using the re-computed angle information 530 created by respective calculation methods, and the angle characteristic adjustment selection screen 901 as shown in FIG. 28 is displayed so that a user can make selections. To be specific, the re-computed angle information 530 is re-computed with respective methods, and the respective re-computed angle information 530 is stored in the angle information storage area 125. Then, respective line segment data 600 is created from the respective re-computed angle information 530, and stored in the line segment data storage area 126. For each line segment data 600, the color data 400 is created and stored in the color data storage area 124. The embroidery data 700 is created from the respective line segment data 600 and the color data 400 that were created. Then, the various preview images are created, showing the final sewn condition based on the various scaling-up or scaling-down methods. The images for preview display are arranged on the angle characteristic adjustment selection screen 901 and displayed on the display 24.

The angle characteristic adjustment selection screen 901, shown in FIG. 28, previews images 9011 shown from the left sewn conditions of the first expansion re-computing method, the second expansion re-computing method and the third expansion re-computing method in this order. Under each of the preview images 9011 radio buttons 9012 are provided to select a calculation method by choosing an image. Under the center of the screen are OK and Cancel buttons. When the OK button is selected, a computing method selected by the radio button 9012 is performed. When the Cancel button is selected, a default computing method (e.g., the third expansion computing method) is selected. The embroidery data 700 based on the re-computed angle information 530, computed by the selected calculation method, is used.

Like the angle characteristic adjustment selection screen 901, as shown in FIG. 28, a computing method may be selected together with the preview display. Only the preview display may be shown and a computing method may be set on other setting screens.

Figure 29:
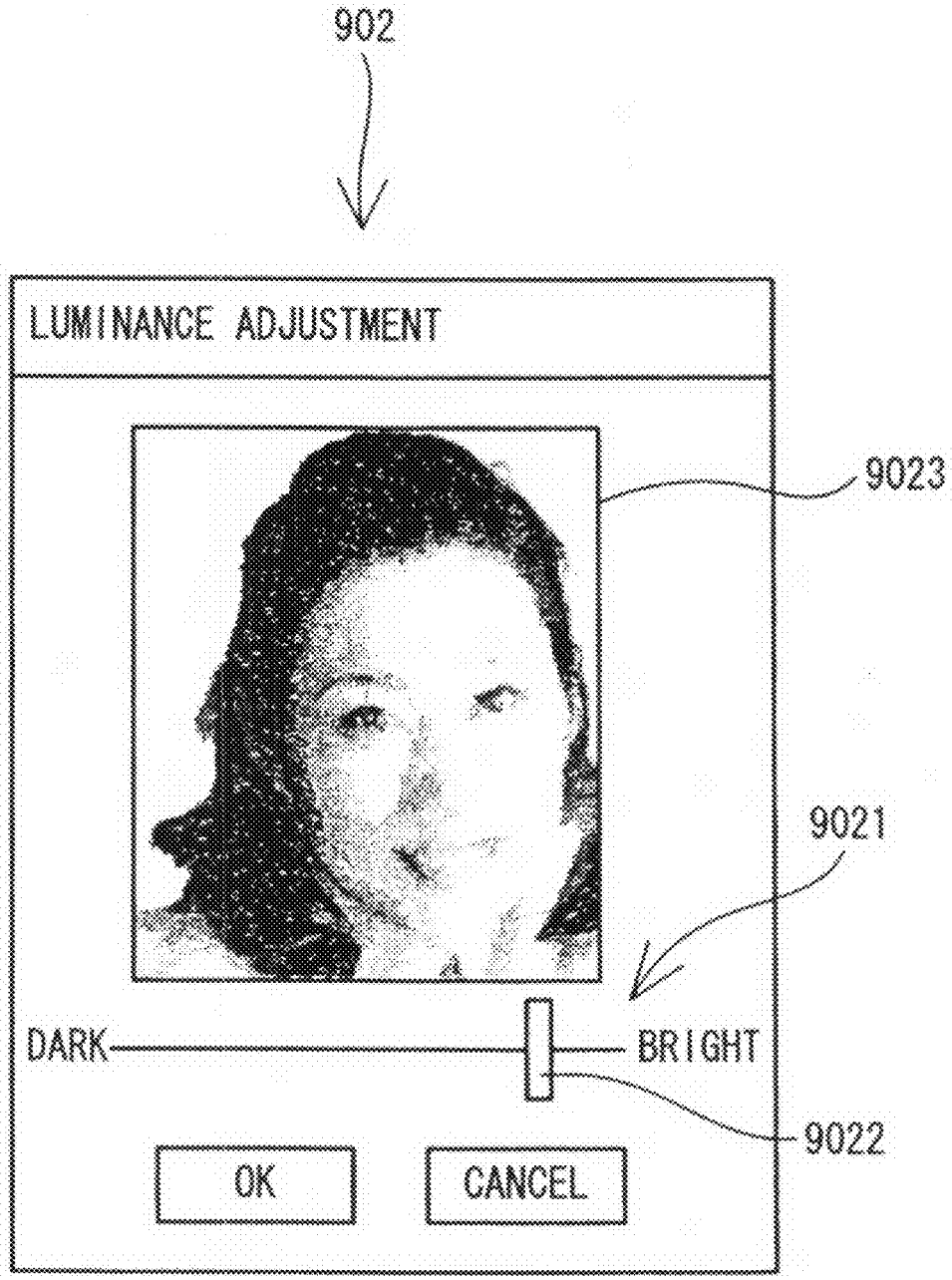
FIG. 29 is a view of luminance adjust screen.

In the above embodiment, although the color data 400 is created from the image data for color 200, and the line segment data 600 at S11 of the flowchart shown in FIG. 6, a user may adjust the tint of the image data for color 200. For example, the luminance adjust screen 902, shown in FIG. 29, is called to appear on the display 24. On the luminance adjust screen 902 is displayed the preview image 9023 showing the sewn condition of embroidery. The bar 9021 for instructing luminance is provided under it, and luminance can be specified by moving the slider 9022. In the example shown in FIG. 29, the more left the slider is, the lower and darker luminance will be, while the more right it is, the higher and brighter luminance will be. The tint of the preview image 9023 changes as the slider 9022 moves.

To be specific, the image data for color 200 is changed to the luminance specified by the slider 9022, and embroidery data 700 is created from the changed image data and the line segment data 600 that is stored in the line segment data storage area 126. Data for displaying the preview image 9023 on the display 24 based on the created embroidery data 700 is created and displayed on the display 24. In addition, under the center of the screen are OK and Cancel buttons. When OK is selected, the luminance specified by the slider 9022 is set. When Cancel is selected, the default luminance is selected.

Luminance may be entered without using the bar 9021 and the slider 9022, shown in FIG. 29. The image data for color 200 with the tint adjusted by some predefined luminance values is created, the color data 400 is created from respective image data and line segment data 600, preview images are displayed, and the most preferable image may be selected therefrom. Alternatively, similar adjustment screens, as shown in FIG. 29, may be used to adjust tint, hue, chroma saturation, contrast, RGB values, etc. Corresponding preview images may be generated based on the customized values chosen.

In the prior art, when the angle characteristic was computed based on changed image data after the image as a whole is made bright, the contrasting density of the image decreases and the strength of the angle characteristic of the entire image decreases. However, in the embroidery data creation apparatus 1 of the present disclosure, since the image data for color 200 for creating the color data 400 and the image data for angle 300 for computing the angle information 500 are different images, no effect is given on the angle information 500, even when the image data for color 200 is changed for adjusting the tint. Another advantage is that when the color data 400 and the angle information 500 are created from the same image data, the changing of any color related data, such as tint or hue, results in the need to recalculate the angle information. Thus, the computation of color data 400 and angle information 500 from the same data set makes it difficult to adjust color characteristics to obtain an optimal output due to the added calculation processing involved. In contrast, in the embroidery data creation apparatus 1 of the present invention, a user may quickly adjust color characteristics such as tint without having to wait on the recalculation of angle information 500.

In addition, in the above embodiment, although the line segment data 600 is created by directly using the computed angle characteristic strength, at S9 of the flowchart shown in FIG. 6, the line segment data 600 may be created after the angle characteristic strength is corrected.

For instance, when line segment data 600 is created, it is determined whether or not values of angle characteristic strengths of all pixels are lower than a predetermined threshold. If so (values of angle characteristic strengths of all pixels are lower than a predetermined threshold), it is determined that a correction is to be made. In addition, the angle characteristic strength takes a value from 0 to 100, and the predetermined threshold is 50, for instance. Thus, the condition is satisfied by a value of the angle characteristic strength when an image of original image data 100 is blurred.

If there exists an outlier among values of the angle characteristics of all pixels, a correction may be made on the angle characteristic strength excluding the outlier. In the case that only a negligible proportion of all values (e.g., 5%) has a value being very different from other values, the very different value is called "an outlier." For instance, if 98% of the whole is a value below 30, and only 2% thereof takes a value above 90, it is determined that any value above 90 is an outliner. Thus, when the line segment data 600 is created, rather than making a determination whether or not the values of the angle characteristic strengths of all the pixels are lower than the predetermined threshold, it is first determined whether or not there is any outlier. If there is an outlier, then it is determined whether or not the values excluding the outlier are lower than the predetermined threshold. If the values other than the outlier are lower the predetermined threshold, then it may be determined that a correction is to be made.

Then, if it is determined that a correction is to be made, a correction is made on each pixel so that a value of the angle characteristic strength will increase, and corrected result is respectively stored in the angle characteristic column of the angle information 500 of the angle information storage area 125, respectively.

Now, for a specific method of correcting the angle characteristic strength, first to fourth methods are described with reference to FIG. 30 to FIG. 33. The threshold in FIG. 30 to FIG. 34 shall be "50," the lower limit in FIG. 31 and FIG. 33 shall be "15," and the outliner in FIG. 34 shall be any value of "90 to 95". Minimum and maximum values of the angle characteristic strength are "0" and "100," respectively.

Figure 30:
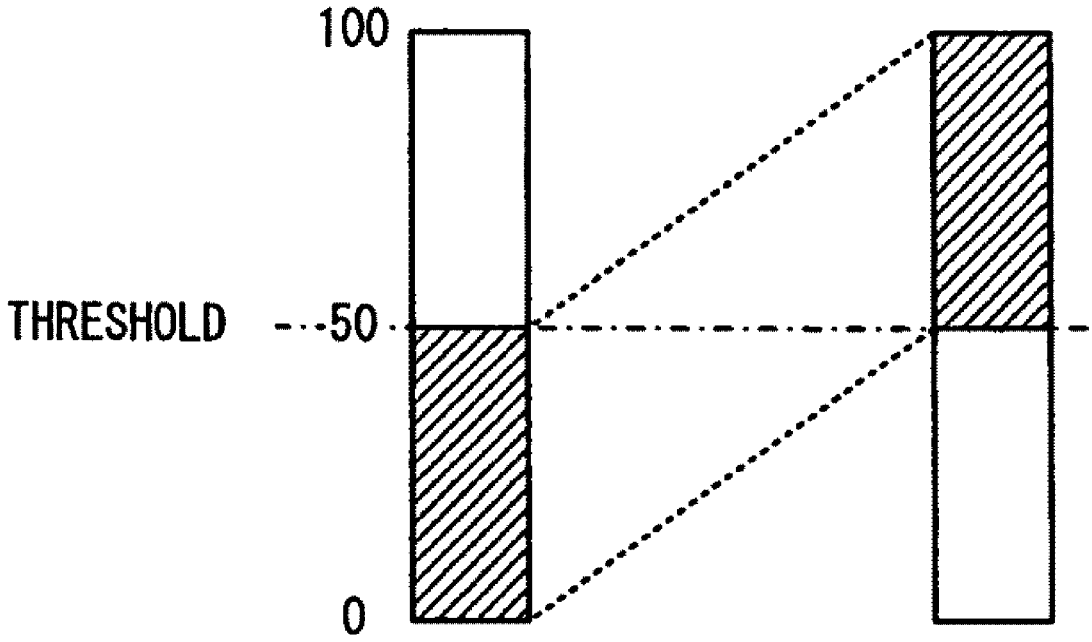
FIG. 30 is a schematic view of the case where correction is made by adding a predetermined value (a first correction method)

The first correction method in which a correction is made by adding a predetermined value, is described in reference to FIG. 30. In this case, a predetermined value to be added is determined so that "50" which is a threshold is corrected to "100," the maximum value. In other words, "100−50=50". When the threshold is "40," the predetermined value to be added is "100−40=60". Since the overall angle characteristic strength increases by adding the predetermined value "50" to all values, embroidery result in natural color can be obtained even when original image is blurry.

Figure 31:
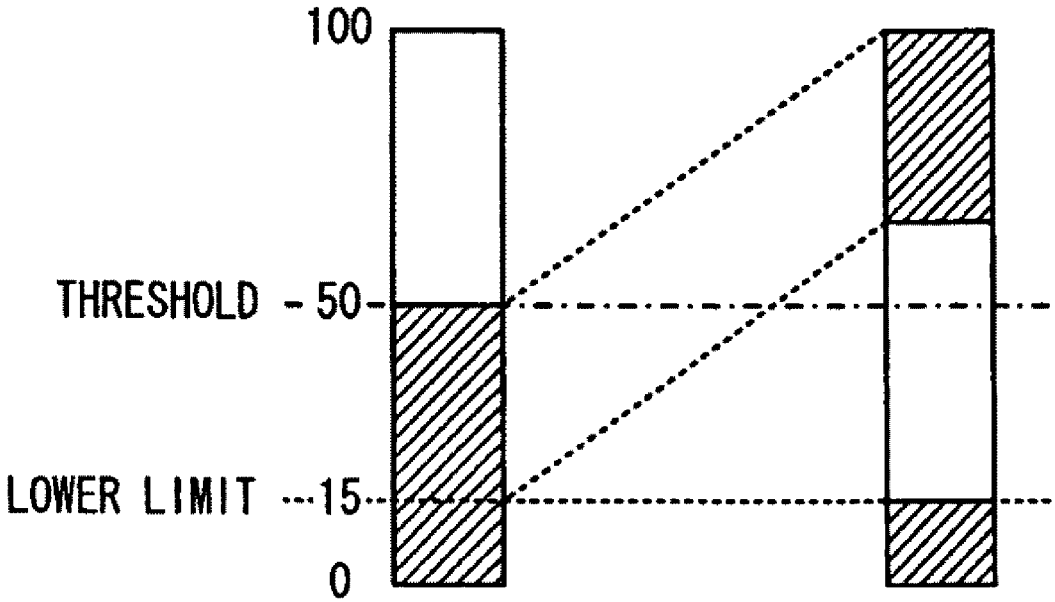
FIG. 31 is a schematic view of the case where correction is made by adding a predetermined value to a value greater than a lower limit value (a second correction method).

The second correction method in which a correction is made by adding a predetermined value to a value greater than a lower limit, is described in reference to FIG. 31. Even in this case, a predetermined value to be added is determined so that "50," which is a threshold is corrected to "100," the maximum value. In this case, as no correction is made on the angle characteristic strength smaller than the lower limit, and the predetermined value is not added to any angle characteristic strength that is "0" or lower, like the first correction method. Thus, any pixels that originally have a low angle characteristic strength are not corrected needlessly, thereby resulting in less noise.

Figure 32:
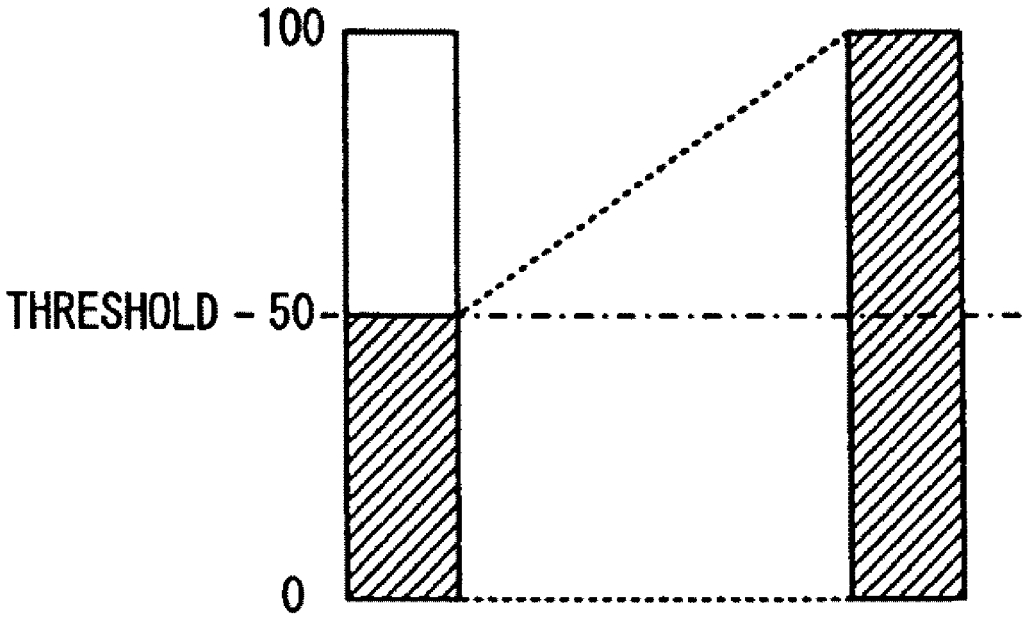
FIG. 32 is a schematic view of the case where correction is made by multiplying by a predetermined value (a third correction method)

The third correction method in which correction is made through multiplication by a predetermined value is described in reference to FIG. 32. A value of "2," obtained by dividing a maximum value "100" by a threshold "50," shall be the predetermined value to multiply. In fact, the maximum value "100" is obtained by multiplying the threshold "50" by the predetermined value. As this results in a stretched angle characteristic strength, and thus correction can be made without changing a ratio of the angle characteristic strengths of respective pixels, a well-balanced embroidery result can be achieved. In addition, since pixels having the angle characteristic strength of "0" remain "0," pixels that have originally no angle characteristic strength shall not be provided with the angle characteristic strength.

Figure 33:
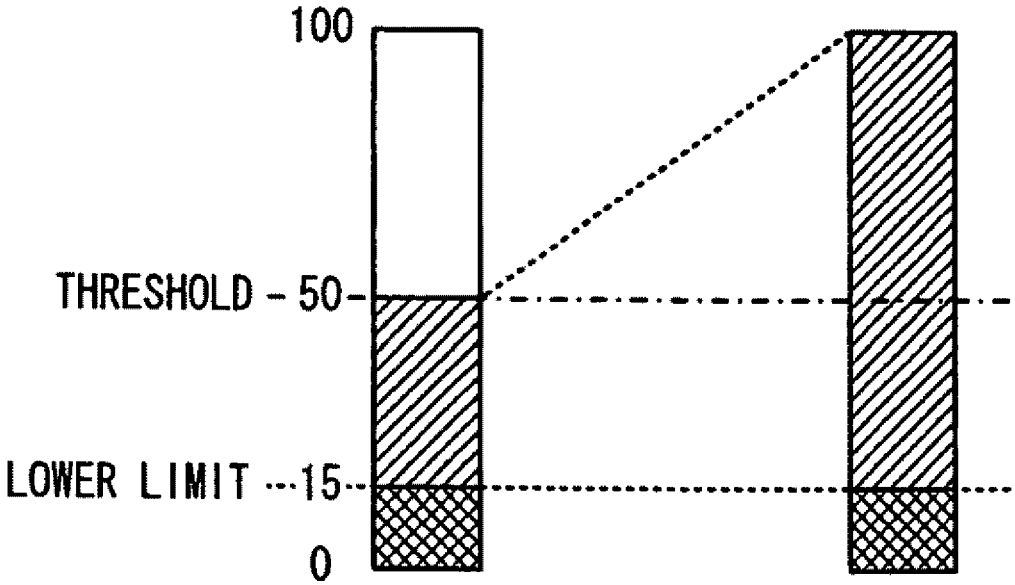
FIG. 33 is a schematic view of the case where correction is made by multiplying a value greater than the lower limit value by a predetermined value (a fourth correction method)

The fourth correction method in which correction is made by multiplying a value greater than a lower limit by a predetermined value is described in reference to FIG. 33. A value obtained by subtracting the lower limit "15" from the maximum value "1100" is divided by a value obtained by subtracting the lower limit "15" from the threshold "50". The resultant value shall be the predetermined value to be multiplied. Thus, "(100−15)/(50−15)=85/35=17/7". However, when a value "49" is corrected, for instance, 49×(17/7)=119, which is greater than the maximum value of "100". Such values greater than the maximum value "100" shall be all set to the maximum value "100". Since any angle characteristic strength that is smaller than the lower limit is not corrected in this case, any pixels that originally have a small angle characteristic strength are not corrected needlessly.

Figure 34:
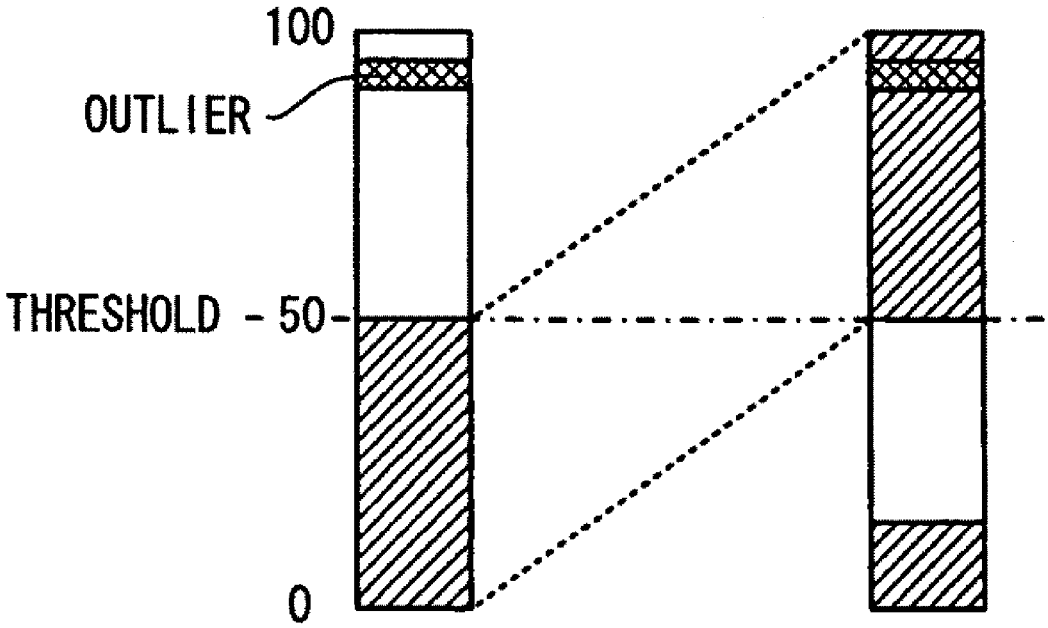
FIG. 34 is a schematic view of the case where correction is made by adding a predetermined value to any values excluding outliers by the first correction method, if angle characteristic strength excluding the outliers is lower than a threshold.

The case in which there is an outlier is described by giving the example of the first correction method in reference to FIG. 34. When there is an outlier, as shown in FIG. 34, a predetermined value is added to any value other than the outlier. This is also true in the second, third and fourth correction methods. The outlier may also be added the predetermined value or multiplied by it. In this case, as a value resulting from the calculation exceeds the maximum value "100," all outliers shall be the maximum value "100."

Figure 35:
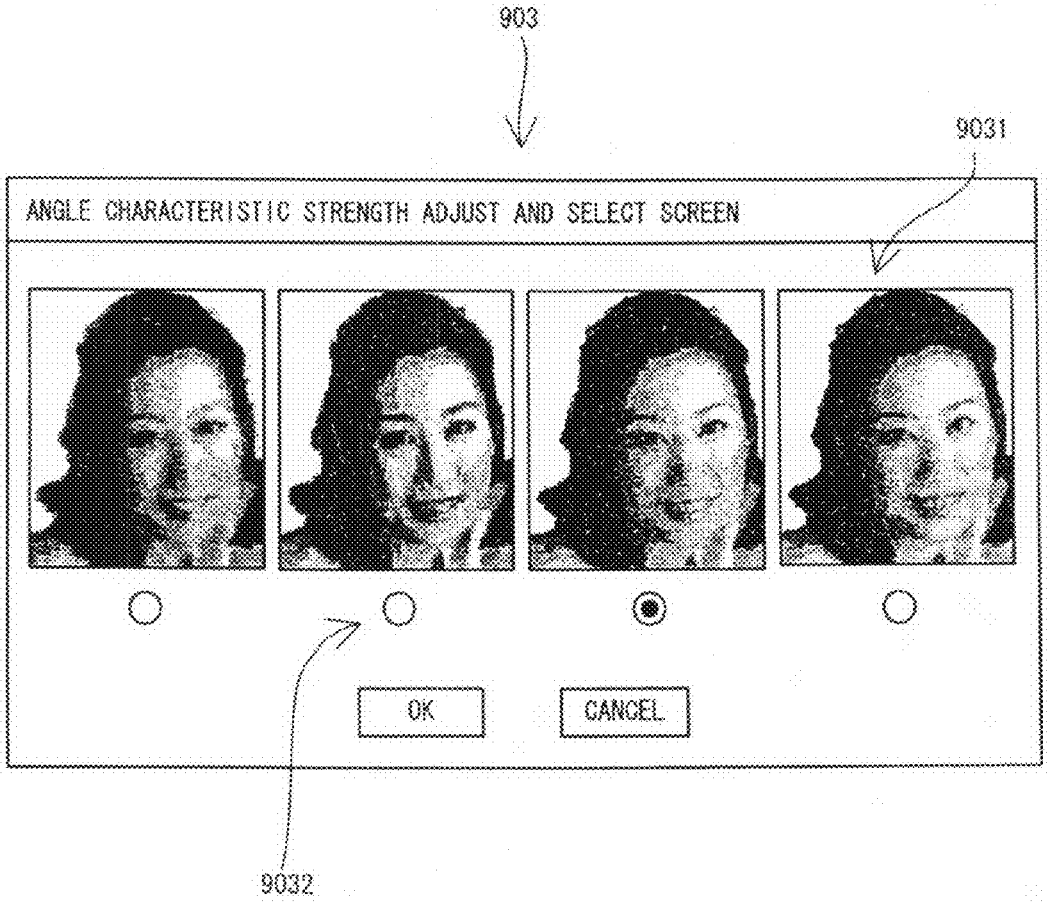
FIG. 35 is a view of angle characteristic strength correction select screen.

Although the angle characteristic strength may be corrected with any of the four methods described above, it may be acceptable to have a user set a correction method. In addition, like the angle characteristic strength correction select screen 903 shown in FIG. 35, it may be acceptable to have the user make a choice. In the example shown in FIG. 35, the preview screens 9031 of the embroidery data created based on the angle characteristic strength corrected by the first to fourth correction methods are displayed from the left in order. Under the respective preview screens 9031 are provided radio buttons 9032 that make it possible to select a correction method by selecting an image. Under the center of the screen are provided OK and Cancel buttons. When OK is selected, a correction method selected by the radio button 9032 is selected. When Cancel is selected, a default computing method (e.g., the fourth correction method) is selected. Thus, the embroidery data 700 created based on the angle characteristic strength corrected by the selected correction method is used.

Figure 36:
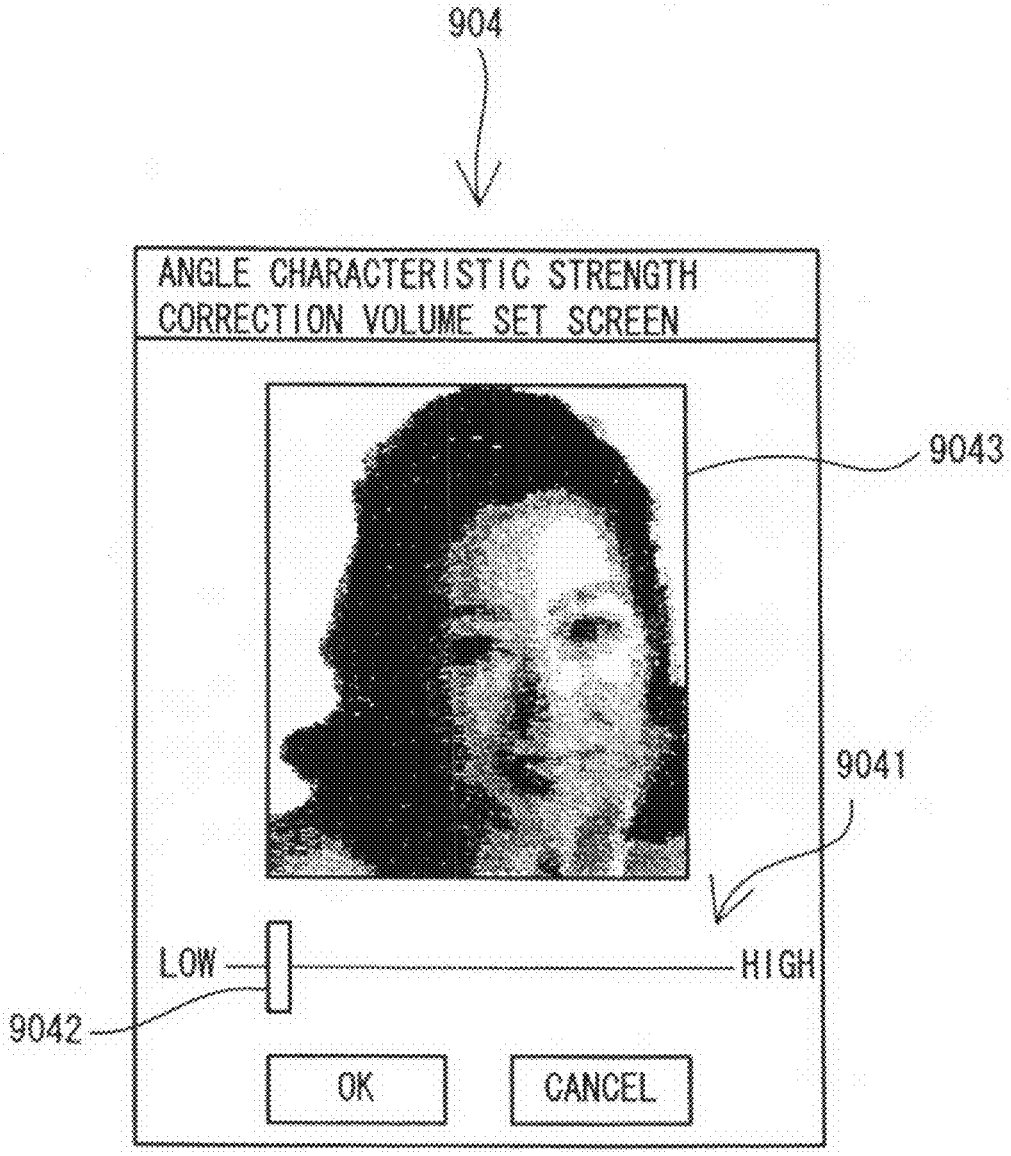
FIG. 36 is a view of angle characteristic strength correction volume set screen.

In addition, in the four correction methods described above, the embroidery data creation apparatus 1 determines a predetermined value that is added to angle characteristic strength or by which to multiply. However, it may be acceptable to have a user specify a predetermined value. In addition, the angle characteristic strength correction volume set screen 904 as shown in FIG. 36 appears on the display 24. A preview image 9043 showing finished embroidery state is displayed on the angle characteristic strength correction volume set screen 904. A bar 9041 by which correction volume is specified is provided under the preview image 9043. A predetermined value can be specified by moving the slider 9042. In the example shown in FIG. 36, the more left the slider is, the lower the predetermined value is. And the more right the slider is, the higher the predetermined value is. The preview image 9043 changes as the slider 9042 moves. A higher predetermined value would give a clearer image.

Although correction of the angle characteristic strength is made immediately before the line segment data 600 is created, the correction may be made after the initial angle information 510 is created and before the re-computed angle information 530 is created.

Also, although the copy of the original image data 100 is directly used as the image data for angle 300 in the above embodiment, the initial angle information 510 may be directly created from the original image data 100 without creating the image data for angle 300. In addition, the size adjusted image data for color 220 may be directly created from the original image data 100 without creating the image data for copying color 210.

In addition, although the embroidery data creation program is stored in CD-ROM 114, it is needless to say that the recording medium is not limited to CD-ROM, and may be other recording medium such as a flexible disk or DVD, etc.

In an embroidery data creation apparatus of the present disclosure, an image data for angle creation device can create, from image data, image data for angle for determining, for each pixel, an angle characteristic showing a direction in which level of color continuity is high and an angle characteristic strength showing the strength of the continuity; an image data for color creation device can create, from image data, image data for color for determining a color of a thread to be used in a sewing machine; an angle information computing device can compute the angle characteristic and the angle characteristic strength for each pixel of the image data for angle created by the image data for angle creation device; an angle information storage device can store, as angle information, the angle characteristic and the angle characteristic strength computed by the angle information computing device; an image data scaling device can expand or reduce size of the image data for color by adding or removing the number pixels comprising the image data for color, depending on size of embroidery data to be created; an angle information re-computing device can re-compute the angle information for each pixel of the image data for color, if size of the image data for color expanded or reduced by the image data scaling device differs from that of the image data for angle; an angle information storage control device can re-store as the angle information, in the angle information storage device, the angle characteristic and the angle characteristic strength computed by the angle information re-computing device; a line segment data creation device can create line segment data showing line segments that are traces of threads to be arranged on respective pixels based on the angle information stored in the angle information storage device; based on the image data for color, a color data creation device can create color data showing a thread color of each line segments of line segment data created by the line segment data creation device; and an embroidery data creation device can create embroidery data based on the line segment data created by the line segment data creation device and the color data created by the color data creation device. Therefore, since the angle information is created based on the image data for angle that is different from the image data for color to be expanded or reduced for use in determining a thread color of embroidery, and then the angle information corresponding to respective pixels of the expanded or reduced color image data is re-computed, expansion or reduction of the color image data gives no effect on the angle characteristic and the angle characteristic strength.

In addition, the embroidery data creation apparatus of the present disclosure can comprise a plurality of angle information re-computing devices having different calculation methods for re-computing an angle characteristic and an angle characteristic strength of each pixel. Therefore, since angle information can be re-computed by a plurality of calculation methods, a plurality of sewn conditions of embroidery to be done according to embroidery data to be created based on the re-computed angle information can also be obtained. Thus, it is possible to have a user select a calculation method that achieves preferable sewn condition, or to use an angle information re-computing device of a different calculation method, depending on image data.

In addition, in the embroidery data creation apparatus of the present disclosure, the angle information re-computing device can compute an angle characteristic and an angle characteristic strength, when image data is expanded by the image data scaling device. At least one of the methods of making the angle characteristic and the angle characteristic strength of the added pixel, that is added by the image data scaling device, may be selected, such as identical values of the angle characteristic and the angle characteristic strength of the original pixel, making the angle characteristic and the angle characteristic strength of the added pixel to zero, and calculating the angle characteristic and angle characteristic strength of the added pixel based on angle characteristic and angle characteristic strength of pixels surrounding that pixel. Therefore, when image data is expanded, it is possible to set the angle characteristic and the angle characteristic strength of the added pixel to appropriate values.

In addition, in the embroidery data creation apparatus 1 of the present disclosure, the angle information re-computing device can compute an angle characteristic and an angle characteristic strength when image data is reduced by the image data scaling device. At least one of the methods of making the angle characteristic and the angle characteristic strength of the remaining pixel that remains after the image data is reduced when the image data scaling device removes pixels identical to values of the angle characteristic and the angle characteristic strength of the original pixel, and calculating the angle characteristic and angle characteristic strength of the remaining pixel based on angle characteristic and angle characteristic strength of pixels surrounding that pixel. Therefore, when image data is reduced, it is possible to set the angle characteristic and the angle characteristic strength of the remaining pixel to appropriate values.

In addition, in the embroidery data creation apparatus of the present disclosure, a display device can display images; a preview display control device can display on the display device sewn condition of when embroidery is done based on embroidery data created by the embroidery data creation device; and by control of the preview display control device, a first multiple preview display control device can display on the display device sewn conditions of each embroidery data created by using the angle characteristic and the angle characteristic strength that are re-computed by the respective angle information re-computing devices. Therefore, a user can check a calculation method whereby preferable sewn condition can be obtained, with an image of sewn conditions to be displayed on the display device.

In addition, in the embroidery data creation apparatus of the present disclosure, an image color changing device can change a color of the image data for color created by the image data for color creation device, and the color data creation device can create the color data based on the image data for color whose color is changed by the image data changing device. Therefore, a user can change colors so as to achieve more preferable sewn condition.

In addition, in the embroidery data creation apparatus of the present disclosure, the image data changing device can change colors by changing at least one of values specifying hue, chroma saturation, color brightness, color contrast, and color. Therefore, colors can be reliably changed by at least one of the values specifying hue, chroma saturation, color brightness, color contrast and color.

In addition, in the embroidery data creation apparatus of the present disclosure, a color change specifying device can specify a degree of color change of the image data for color by the image data changing device. Therefore, a user can easily change colors of the image data for color simply by specifying the degree and without giving a complicated instruction in particular.

In addition, in the embroidery data creation apparatus of the present disclosure, a display device displays images; a preview display control device displays on the display device sewn conditions of when embroidery is done based on the embroidery data created by the embroidery data creation device; and a second multiple preview display control device can create each color data by the color data creation device, based on a plurality of the image data pieces for color that made different color changes to the image data for color by the image color changing device; and display on the display device sewn conditions of each embroidery data created by using respective color data under the control of the preview display control device. Therefore, sewn conditions resulting from color changes can be checked.

In addition, in the embroidery data creation apparatus of the present disclosure, a correction determination device can determine whether or not the angle characteristic strength is to be corrected, depending on whether or not values of all pixels are lower than a predetermined threshold, in the angle characteristic strength of the angle information stored in the angle information storage device; a correction device can correct the angle characteristic strength of the angle information stored in the angle information storage device, if the correction determination device determines that it is to be corrected; and a corrected angle information storage control device can store the angle information corrected by the correction device, in the angle information storage device. Thus, even though image data has a blurred image, sharpened and unblurred sewn condition can be achieved through correction of the angle information.

In addition, in the embroidery data creation apparatus of the present disclosure, if an angle characteristic strength of angle information stored in the angle information storage device has any pixel taking an outlier, the correction determination device can determine that a correction is to be made when values of pixels other than the pixel taking the outlier are lower than a predetermined threshold. Therefore, clearer and unblurred sewn condition can be achieved, even from image data of which image has a clear part in one area only but is blurred as a whole.

In addition, in the embroidery data creation apparatus of the present disclosure, the correction device makes corrections by adding a predetermined value to an angle characteristic strength or by multiplying the angle characteristic strength by the predetermined value. If the calculation results in a value higher than a maximum value of the angle characteristic strength, the maximum value can be a corrected value. Therefore, correction can be made through simple calculation.

In the embroidery data creation program of the present disclosure, an image data for angle creation step can create, from image data, image data for angle for determining, for each pixel, an angle characteristic showing a direction in which level of color continuity is high and an angle characteristic strength showing the strength of color continuity; an image data for color creation step can create from image data for color for determining a thread color to be used in a sewing machine; an angle information computing step can compute the angle characteristic and the angle characteristic strength for each pixel of the image data for angle created in the image data for angle creation step; an angle information storage step can store, as angle information, the angle characteristic and the angle characteristic strength computed in the angle information computing step; an image data scaling step can expand or reduce size of the image data for color by adding or removing the number of pixels comprising the image data for color, depending on size of embroidery data; an angle information re-computing step can re-compute the angle information for each pixel of the image data for color, if size of the image data for color expanded or reduced in the image data scaling step differs from that of the image data for angle; an angle information re-storage step can restore as angle information the angle characteristic and the angle characteristic strength computed in the angle information re-computing step; a line segment data creation step can create line segment data showing line segments that are traces of threads to be arranged on respective pixels, based on the angle information stored in the angle information storage step or the angle information stored in the angle information re-storage step if the same angle information re-storage step has been gone through; a color data creation step can create color data showing a thread color of each line segment of the line segment data created in the line segment data creation step, based on the image data for color; and an embroidery data creation step can create the embroidery data based on the line segment data created in the line segment creation step and the color data created in the color data creation step. Therefore, since the angle information is created based on the image data for angle that is different from the image data for color to be expanded or reduced for use in determining a thread color of embroidery, and then the angle information corresponding to respective pixels of the expanded or reduced color image data is re-computed, expansion or reduction of the color image data gives no effect on the angle characteristic and the angle characteristic strength.

In addition, the embroidery data creation program of the present disclosure can comprise a plurality of angle information re-computation steps having different calculation methods for re-computing an angle characteristic and an angle characteristic strength of each pixel. Therefore, since angle information can be re-computed by not only one calculation method but also a plurality of calculation methods, a plurality of sewn conditions of embroidery to be done according to embroidery data to be created based on the re-computed angle information can also be obtained. Thus, it is possible to have a user select a calculation method that achieves more preferable sewn condition, or to use an angle information re-computing step of a different calculation method, depending on image data.

In addition, in the embroidery data creation program of the present disclosure, the angle information re-computation step can compute an angle characteristic and an angle characteristic strength, when image data is expanded in the image data scaling step, with at least one of the methods of making an angle characteristic and an angle characteristic strength of the added pixel that is added in the image data scaling step identical to values of the angle characteristic and the angle characteristic strength of an original pixel, making the angle characteristic and the angle characteristic strength of the added pixel to zero, and calculating the angle characteristic and angle characteristic strength of the added pixel based on angle characteristic and angle characteristic strength of pixels surrounding that pixel. Therefore, when image data is expanded, it is possible to set the angle characteristic and the angle characteristic strength of the added pixel to appropriate values.

In addition, in the embroidery data creation program of the present disclosure, the angle information re-computation step can compute an angle characteristic and an angle characteristic strength when image data is reduced in the image data scaling step, with at least one of the methods of making an angle characteristic and an angle characteristic strength of the remaining pixel that remains after pixels are removed to reduce image data in the image scaling step identical to values of the angle characteristic and the angle characteristic strength of the original pixel, and calculating the angle characteristic and angle characteristic strength of the remaining pixel based on angle characteristic and angle characteristic strength of pixels surrounding that pixel. Therefore, when image data is reduced, it is possible to set the angle characteristic and the angle characteristic strength of the remaining pixel to appropriate values.

In addition, in the embroidery data creation program of the present disclosure, a display step can display images; a preview display control step can display sewn condition of when embroidery is done based on embroidery data created in the embroidery data creation step; and a first multiple preview display control step can display sewn conditions of each embroidery data created by using the angle characteristic and the angle characteristic strength that are re-computed in the respective angle information re-computing steps, by control in the preview display control step. Therefore, a user can check a calculation method whereby preferable sewn condition can be obtained, with an image of sewn conditions to be displayed.

In addition, in the embroidery data creation program of the present disclosure, an image color changing step can change a color of the image data for color created in the image data for color creation step, and the color data creation step can create the color data based on the image color whose color is changed in the image data for color changing step. Therefore, a user can change colors so as to achieve more preferable sewn condition.

In addition, in the embroidery data creation program of the present disclosure, the image data changing step can change colors by changing at least one of values specifying hue, chroma saturation, color brightness, color contrast, and color. Therefore, colors can be reliably changed by at least one of the values specifying hue, chroma saturation, color brightness, color contrast and color.

In addition, in the embroidery data creation program of the present disclosure, a color change specifying step can specify a degree of color change of the image data for color in the image color changing step. Therefore, a user can easily change colors of the image data for color simply by specifying the degree and without giving a complicated instruction in particular.

In addition, in the embroidery data creation program of the present disclosure, a display step can display images, a preview display control step can display sewn conditions of when embroidery is done based on the embroidery data created in the embroidery data creation step, and a second multiple preview display control step can create each color data in the color data creation step, based on a plurality of the image data pieces for color that made different color changes to the image data for color in the image color changing step, and display sewn conditions of each embroidery data created by using respective color data, under the control of the preview display control step. Therefore, sewn conditions resulting from color changes can be confirmed.

In addition, in the embroidery data creation program of the present disclosure, a correction determination step can determine whether or not to correct the angle characteristic strength, depending on whether or not values of all pixels are lower than a predetermined threshold, in the angle characteristic strength of the angle information stored in the angle information storage step, or the angle information stored in the angle information re-computing step if the same angle information re-computing step has been gone through; a correction step can correct the angle characteristic strength if the correction determination step determines to correct the same angle characteristic strength; and a corrected angle information storage step can store the angle information corrected in the correction step. Therefore, it is possible to achieve a clearer and unblurred sewn condition by correcting the angle information even when the image of the image data is blurred.

In addition, in the embroidery data creation program of the present disclosure, the correction determination step can determine that correction is to be made if there is a pixel taking an outlier in the angle characteristic strength of the angle information stored in the angle information storage step, and when values of pixels other than the pixel taking the outlier are lower than a predetermined threshold. Therefore, clearer sewn condition can be achieved, as far as an even from image data of which has a clear part in one area only but is blurred as a whole.

In addition, in the embroidery data creation program of the present disclosure, the correction step makes corrections by adding a predetermined value to an angle characteristic strength or by multiplying the angle characteristic strength by the predetermined value. If the calculation results in a value higher than a maximum value of the angle characteristic strength, the maximum value can be a corrected value. Therefore, correction can be made through simple calculation.

In the illustrated embodiment, the controller (control section 6) preferably is implemented using a suitably programmed general purpose computer, e.g., a microprocessor, microcontroller or other processor device (CPU or MPU). It will be appreciated by those skilled in the art that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the disclosure.

What is claimed is:

1. An embroidery data creation apparatus comprising:

an angle data creation device that creates angle data from image data comprised of a collection of pixels and that forms an image, wherein the angle data determines an angle characteristic that represents a direction in which level of color continuity is high and an angle characteristic strength that represents strength of the continuity, for each pixel in the image data;

a color data creation device that creates color data from the image data, wherein the color data determines a thread color to be used in a sewing machine for embroidering an image corresponding to the embroidery data;

an angle information computing device that computes the angle characteristic and the angle characteristic strength for each pixel of the angle data created by the angle data creation device;

an angle information storage device that stores, as angle information, the angle characteristic and the angle characteristic strength computed by the angle information computing device;

an image data scaling device that expands or reduces a size of the color data by adding or removing the number of pixels comprising the color data, depending on a size of the embroidery data to be created;

an angle information re-computing device that re-computes the angle information for each pixel of the color data, if the size of the color data expanded or reduced by the image data scaling device differs from that of the angle data;

an angle information storage control device that re-stores the angle characteristic and the angle characteristic strength computed by the angle information re-computing device as angle information in the angle information storage device;

a line segment data creation device that creates line segment data that represents line segments that are traces of threads to be arranged on respective pixels, based on the angle information stored in the angle information storage device;

a color data creation device that creates color data that represents a thread color of each line segment of the line segment data created by the line segment data creation device based on the color data; and an embroidery data creation device that creates the embroidery data based on the line segment data created by the line segment data creation device and the color data created by the color data creation device.

2. The embroidery data creation apparatus of claim 1 further comprising a plurality of the angle information re-computing devices each with a different calculation method for re-computing the angle characteristic and an angle characteristic strength of each pixel.

3. The embroidery data creation apparatus of claim 1, wherein the angle information re-computing device computes the angle characteristic and the angle characteristic strength with at least one of the following methods when the image data is expanded by the image data scaling device:

setting the angle characteristic and the angle characteristic strength of an added pixel, that is added by the image data scaling device, identical to values of the angle characteristic and the angle characteristic strength of the original pixel;

setting the angle characteristic and the angle characteristic strength of the added pixel to zero; and calculating the angle characteristic and the angle characteristic strength of the added pixel based on the angle characteristic and the angle characteristic strength of the pixels surrounding the pixel.

4. The embroidery data creation apparatus of claim 1, wherein the angle information re-computing device computes the angle characteristic and the angle characteristic strength with at least one of the following methods when the image data is reduced by the image data scaling device:

setting the angle characteristic and the angle characteristic strength of a remaining pixel, that remains after the image data is reduced when the image data scaling device removes pixels identical, to values of the angle characteristic and the angle characteristic strength of the original pixel; and calculating the angle characteristic and the angle characteristic strength of the remaining pixel based on the angle characteristic and the angle characteristic strength of the pixels surrounding the remaining pixel.

5. The embroidery data creation apparatus of claim 1, further comprising:

a display device that displays images;

a preview display control device that displays, on the display device a preview of a sewn condition based on the embroidery data created by the embroidery data creation device; and a first multiple preview display control device that displays, on the display device, a preview of a sewn condition for each embroidery data created by using the angle characteristic and the angle characteristic strength that are re-computed by the respective angle information re-computing devices, under the control of the preview display control device.

6. The embroidery data creation apparatus of claim 1, further comprising an image color changing device that changes a color of the color data created by the color data creating device, wherein the color data creation device creates the color data based on the color data whose color is changed by the image color changing device.

7. The embroidery data creation apparatus of claim 6, wherein the image color changing device changes a color by changing at least one of hue, chroma saturation, color brightness, color contrast and color.

8. The embroidery data creation apparatus of claim 6, further comprising a color change specifying device that specifies a degree of changes of a color of the color data by the image color changing device, wherein the image color changing device changes a color of the color data based on the specification of the color change specifying device.

9. The embroidery data creation apparatus of claim 6, further comprising:

a display device that displays images;

a preview display control device that displays, on the display device, a preview of a sewn condition based on the embroidery data created by the embroidery data creation device; and a second multiple preview display control device that creates the each color data by the color data creation device, based on a plurality of the image data pieces for color that made different color changes to the color data by the image color changing device, and displays on the display device a preview of a sewn condition of each embroidery data created by using the each color data, under the control of the preview display control device.

10. The embroidery data creation apparatus of claim 1, further comprising:

a correction determination device that determines whether or not to correct the angle characteristic strength of the angle information stored in the angle information storage device, depending on whether or not values of all pixels are lower than a predetermined threshold;

a correction device that corrects the angle characteristic strength of the angle information stored in the angle information storage device if the correction determination device determines that it is to be correct; and a corrected angle information storage control device that stores in the angle information storage device the angle information corrected by the correction device.

11. The embroidery data creation apparatus of claim 10, wherein if there is any pixel that takes an outlier in the angle characteristic strength of the angle information stored in the angle information storage device, the correction determination device determines that a correction is to be made when values of pixels other than the pixel that takes the outlier are lower than the predetermined threshold.

12. The embroidery data creation apparatus of claim 10, wherein the correction device corrects by:

performing a calculation by adding a predetermined value to the angle characteristic strength, or performing a calculation by multiplying the angle characteristic strength by the predetermined value, wherein if the calculation results in a value higher than a maximum value of the angle characteristic strength, the maximum value shall be the corrected value.

13. A storage medium storing an embroidery data creation program executable on a data processing device, the program comprising:

an angle data creation step that creates angle data from image data comprised of a collection of pixels and that forms an image, wherein the angle data determines an angle characteristic that represents a direction in which level of color continuity is high and an angle characteristic strength that represents the strength of continuity, for each pixel in the image data;

a color data creation step that creates color data from the image data, wherein the color data determines a thread color to be used in a sewing machine for embroidering an image corresponding to the embroidery data;

an angle information computing step that computes the angle characteristic and the angle characteristic strength for each pixel of the angle data created in the angle data creation step;

an angle information storage step that stores, as angle information, the angle characteristic and the angle characteristic strength computed in the angle information computing step;

an image data scaling step that expands or reduces a size of the color data by adding or removing the number of pixels comprising the color data, depending on a size of the embroidery data to be created;

an angle information re-computing step that re-computes the angle information for each pixel of the color data, if the size of the color data that is expanded or reduced in the image data scaling step differs from that of the angle data;

an angle information re-storage step that re-stores the angle characteristic and the angle characteristic strength computed in the angle information re-computing step as angle information;

a line segment data creation step that creates line segment data that represents line segments that are traces of threads to be arranged on respective pixels based on either the angle information stored in the angle information storage step or the angle information stored in the angle information re-storage step if the angle information re-storage step was performed;

a color data creation step that creates color data that represents a thread color of each line segment of the line segment data created in the line segment data creation step, based on the color data; and an embroidery data creation step that creates the embroidery data based on the line segment data created in the line segment data creation step and the color data created in the color data creation step.

14. The storage medium of claim 13 comprising a plurality of the angle information re-computing steps with a plurality of different calculation methods to recompute the angle characteristic and the angle characteristic strength for each pixel.

15. The storage medium of claim 13, wherein in the angle information re-computing step, the angle characteristic and the angle characteristic strength are computed with at least one of the following methods when the image data is expanded in the image data scaling step:

setting the angle characteristic and the angle characteristic strength of an added pixel that is added in the image data scaling step identical to values of the angle characteristic and the angle characteristic strength of the original pixel;

setting the angle characteristic and the angle characteristic strength of the added pixel to zero; and calculating the angle characteristic and the angle characteristic strength of the added pixel based on the angle characteristic and the angle characteristic strength of the pixels surrounding the added pixel.

16. The storage medium of claim 13, wherein in the angle information re-computing step, the angle characteristic and the angle characteristic strength are computed with at least one of the following methods when the image data is reduced in the image data scaling step:

setting the angle characteristic and the angle characteristic strength of a remaining pixel, that remains after the image data is reduced when the image scaling step removes pixels, to values identical to the angle characteristic and the angle characteristic strength of the original pixel, and calculating the angle characteristic and the angle characteristic strength of the remaining pixel based on the angle characteristic and the angle characteristic strength of the pixels surrounding the remaining pixel.

17. The storage medium of claim 13, further comprising:

a display step that displays images;

a preview display control step that displays a preview of a sewn condition of when embroidery is done based on the embroidery data created in the embroidery data creation step; and a first multiple preview display control step that displays a preview of the sewn condition of each embroidery data created by using the angle characteristic and the angle characteristic strength that are re-computed in the respective angle information re-computing steps, under the control of the preview display control step.

18. The storage medium of claim 13, further comprising an image color changing step that changes a color of the color data created in the color data creation step, wherein, in the color data creation step, the color data is created based on the color data whose color is changed in the image color changing step.

19. The storage medium of claim 18 wherein, in the image color changing step, a color is changed by changing at least one of hue, chroma saturation, color brightness, color contrast, and color.

20. The storage medium of claim 18, further comprising a color change specifying step that specifies a degree of change of a color of the color data in the image color changing step, wherein, in the image color changing step, a color of the color data is changed based on the specification in the color change specifying step.

21. The storage medium of claim 18, further comprising:

a display step that displays images;

a preview display control step that displays a preview of a sewn condition of when embroidery is done based on the embroidery data created in the embroidery data creation step; and a second multiple preview display control step that creates the each color data in the color data creation step, based on a plurality of the image data pieces for color that made different color changes to the color data in the image color changing step, and displays a preview of a sewn condition of each embroidery data created by using the each color data, under the control of the preview display control step.

22. The storage medium of claim 13, further comprising:

a correction determination step that determines whether or not to correct the angle characteristic strength of the angle information stored in the angle information storage step or the angle information stored in the angle information re-storage step if the same angle information re-storage step has been gone through, depending on whether or not values of all pixels are lower than a predetermined threshold;

a correction step that corrects the angle characteristic strength if the correction determination step determines that the angle characteristic strength requires correction; and a corrected angle information storage step that stores the angle information corrected in the correction step.

23. The storage medium of claim 22 wherein, if there is any pixel that takes an outlier in the angle characteristic strength of the angle information stored in the angle information storage step, it is determined in the correction determination step that a correction is to be made when values of pixels other than the pixel that takes the outlier are lower than the predetermined threshold.

24. The storage medium of claim 22 wherein:

in the correction step, a correction is made by:

adding a predetermined value to the angle characteristic strength or multiplying the angle characteristic strength by the predetermined value, wherein if the calculation results in a value higher than a maximum value of the angle characteristic strength, the maximum value shall be the corrected value.

* * * * *